US011295662B2

(12) United States Patent
Jeon et al.

(10) Patent No.: US 11,295,662 B2
(45) Date of Patent: Apr. 5, 2022

(54) DISPLAY DEVICE

(71) Applicant: Samsung Display Co., Ltd., Yongin-Si (KR)

(72) Inventors: Jae-Hyeon Jeon, Seoul (KR); Yu-Chol Kim, Jeonju-si (KR); Jihye Kim, Hwaseong-si (KR); Jin-Wook Yang, Suwon-si (KR); Donggyu Lee, Suwon-si (KR); Jakyoung Jin, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/191,588

(22) Filed: Mar. 3, 2021

(65) Prior Publication Data

US 2021/0375192 A1 Dec. 2, 2021

(30) Foreign Application Priority Data

May 29, 2020 (KR) ..... 10-2020-0065035

(51) Int. Cl.
*G09G 3/3233* (2016.01)
*G09G 3/32* (2016.01)

(52) U.S. Cl.
CPC ..... *G09G 3/32* (2013.01); *G09G 2300/0426* (2013.01); *G09G 2310/0267* (2013.01); *G09G 2310/0275* (2013.01); *G09G 2330/021* (2013.01)

(58) Field of Classification Search
CPC ..... G09G 3/32; G09G 2300/0426; G09G 2330/021; G09G 2310/0275; G09G 2310/0267
See application file for complete search history.

(56) References Cited

U.S. PATENT DOCUMENTS

| | | | | |
|---|---|---|---|---|
| 8,957,837 | B2 * | 2/2015 | Han | G09G 3/3233 345/78 |
| 10,001,873 | B2 | 6/2018 | Kim et al. | |
| 10,192,489 | B1 * | 1/2019 | Liu | G09G 3/3258 |
| 10,733,939 | B2 * | 8/2020 | Xi | G09G 3/3258 |
| 11,011,118 | B2 * | 5/2021 | Lin | G09G 3/32 |
| 2005/0200575 | A1 * | 9/2005 | Kim | G09G 3/3233 345/76 |
| 2009/0051628 | A1 * | 2/2009 | Kwon | G09G 3/3233 345/77 |
| 2010/0013816 | A1 * | 1/2010 | Kwak | G09G 3/3233 345/211 |

(Continued)

FOREIGN PATENT DOCUMENTS

| | | | |
|---|---|---|---|
| KR | 10-1162864 | B1 | 7/2012 |
| KR | 10-2017-0065090 | A | 6/2017 |

(Continued)

*Primary Examiner* — Jose R Soto Lopez
(74) *Attorney, Agent, or Firm* — Innovation Counsel LLP

(57) ABSTRACT

A display device includes a display panel including a pixel, a voltage line supplying a power voltage to the pixel, and a reference voltage line supplying one of a reference voltage and the power voltage to the pixel; a mode selector configured to output one of a first selection signal and a second selection signal according to an operation mode of the display panel; and a switch configured to provide the reference voltage or the power voltage to the reference voltage line in response to one of the first selection signal and the second selection signal.

21 Claims, 12 Drawing Sheets

(56) References Cited

U.S. PATENT DOCUMENTS

2010/0109985 A1* 5/2010 Ono ..... G09G 3/3233 345/76
2011/0025659 A1* 2/2011 Kwak ..... G09G 3/3233 345/205
2011/0057917 A1* 3/2011 Ryu ..... G09G 3/3233 345/211
2012/0212476 A1* 8/2012 Yamauchi ..... G09G 3/3648 345/212
2012/0212521 A1* 8/2012 Yamauchi ..... G09G 3/3659 345/690
2013/0113775 A1* 5/2013 Seo ..... G09G 3/3208 345/211
2016/0027146 A1* 1/2016 Kim ..... G06F 3/14 345/629
2017/0018220 A1* 1/2017 Takahara ..... G09G 3/3233
2017/0061877 A1* 3/2017 Lee ..... H01L 27/3262
2017/0069262 A1* 3/2017 Wu ..... G09G 3/3233
2017/0069263 A1* 3/2017 Hu ..... G09G 3/32
2018/0061315 A1* 3/2018 Kim ..... G09G 3/3225
2018/0158407 A1* 6/2018 Chai ..... G09G 3/3275
2018/0174513 A1* 6/2018 Lee ..... G09G 3/3233
2018/0293939 A1* 10/2018 Kim ..... H01L 51/5203
2018/0315374 A1* 11/2018 Zhang ..... G09G 3/3233
2020/0013345 A1 1/2020 Jeong
2020/0152130 A1* 5/2020 Hong ..... G09G 3/3233
2020/0168164 A1* 5/2020 Park ..... H01L 27/326
2020/0265778 A1* 8/2020 Lee ..... G09G 3/3233
2021/0183304 A1* 6/2021 Takasugi ..... G09G 3/3233
2021/0183308 A1* 6/2021 Xuan ..... G09G 3/3266

FOREIGN PATENT DOCUMENTS

KR 10-2017-0083695 A 7/2017
KR 10-2020-0004483 A 1/2020
KR 10-2073869 B1 2/2020

* cited by examiner

DISPLAY DEVICE

CROSS-REFERENCE TO RELATED APPLICATIONS

This U.S. non-provisional patent application claims priority under 35 U.S.C. § 119 of Korean Patent Application No. 10-2020-0065035, filed on May 29, 2020, the disclosure of which is hereby incorporated by reference in its entirety.

BACKGROUND

The present disclosure herein relates to a display device, and more particularly, to a display device with improved overall display quality.

A display device may include various electronic components such as a display panel for displaying an image, an input detection member for detecting an external input, and an electronic module. The electronic components can be electrically interconnected by variously arranged signal lines. The display panel includes a plurality of pixels. Each of the plurality of pixels includes a light emitting element that generates light and a circuit that controls an amount of current flowing through the light emitting element.

A leakage current generated in a circuit in a pixel may change the amount of current flowing through the light emitting element and deteriorate display quality of the display device.

SUMMARY

The present disclosure provides a display device capable of improving display quality according to an operation mode of a display panel.

According to an embodiment of the inventive concept, a display device includes: a display panel including a pixel, a voltage line supplying a power voltage to the pixel, and a reference voltage line supplying one of a reference voltage and the power voltage to the pixel; a mode selector configured to output one of a first selection signal and a second selection signal according to an operation mode of the display panel; and a switch configured to provide the reference voltage or the power voltage to the reference voltage line in response to one of the first selection signal and the second selection signal.

The switch may include: a first switching element configured to supply the reference voltage to the reference voltage line in response to the first selection signal; and a second switching element configured to supply the power voltage to the reference voltage line in response to the second selection signal.

When the display panel operates in a first mode for displaying a still image, the mode selector may activate the first selection signal, and when the display panel operates in a second mode for displaying a video, the mode selector may activate the second selection signal.

The display panel may include a display area in which a plurality of pixels is arranged and a peripheral area adjacent to the display area, and the first switching element and the second switching element may be disposed in the peripheral area of the display panel.

The second switching element may receive the power voltage through the voltage line.

The pixel may include: a light emitting element including a cathode and an anode; a first transistor connected between the anode of the light emitting element and the voltage line; a second transistor connected between a data line that provides a data signal and the first transistor; a first capacitor connected between a first node and the voltage line; and a second capacitor connected between the first transistor and the second transistor.

The first transistor may include: a first electrode connected to the voltage line; a second electrode connected to the second capacitor at a second node; and a third electrode connected to the anode of the light emitting element. The second transistor may include: a first electrode connected to the data line; a second electrode configured to receive a write scan signal; and a third electrode connected to the first node.

The pixel may further include: a third transistor including a first electrode connected to the reference voltage line, a second electrode configured to receive a compensation scan signal, and a third electrode connected to the first node.

An activation period of the compensation scan signal may have a first duration that is longer than a second duration of an activation period of the write scan signal.

The compensation scan signal may be activated before the write scan signal is activated.

The pixel may further include: a fourth transistor including a first electrode connected to the second electrode of the first transistor, a second electrode configured to receive the compensation scan signal, and a third electrode connected to the third electrode of the first transistor; and a fifth transistor including a first electrode connected to the third electrode of the first transistor, a second electrode configured to receive a light emission control signal, and a third electrode connected to the anode of the light emitting element.

The compensation signal within the deactivation period of the light emission control signal may be activated before the write scan signal is activated.

The pixel may further include: a sixth transistor including a first electrode connected to an initialization voltage line, a second electrode configured to receive an initialization scan signal, and a third electrode connected to the second electrode of the first transistor; and a seventh transistor including a first electrode connected to the initialization voltage line, a second electrode configured to receive a black scan signal, and a third electrode connected to the anode of the light emitting element.

The compensation scan signal may be activated before the write scan signal is activated, and the initialization scan signal may be activated before the compensation scan signal is activated.

A first activation period of the compensation scan signal and a second activation period of the initialization scan signal may be greater than a third activation period of the write scan signal.

The write scan signal may be activated before the black scan signal is activated.

In an embodiment of the inventive concept, a display device includes: a display panel including a pixel, a voltage line supplying a power voltage to the pixel, and a reference voltage line supplying one of a reference voltage and the power voltage to the pixel; a mode selector configured to output one of a first selection signal and a second selection signal according to an operation mode of the display panel; and a switch configured to provide the reference voltage or the power voltage to the reference voltage line in response to one of the first selection signal and the second selection signal.

The pixel includes: a light emitting element including a cathode and an anode; a first transistor connected between the anode of the light emitting element and the voltage line; a second transistor connected between a data line that provides a data signal and the first transistor; a first capacitor connected between a first node and the voltage line; a second capacitor connected between the first transistor and the second transistor; and a third transistor connected between the reference voltage line and the second transistor, wherein the third transistor is turned on during a compensation period for compensating a potential of the first node, and the compensation period precedes a data write period in which the data signal is applied.

The first transistor may include: a first electrode connected to the voltage line; a second electrode connected to the second capacitor at a second node; and a third electrode connected to the anode of the light emitting element. The second transistor may include: a first electrode connected to the data line; a second electrode configured to receive a write scan signal; and a third electrode connected to the first node. The third transistor may include: a first electrode connected to the reference voltage line; a second electrode configured to receive a compensation scan signal; and a third electrode connected to the first node.

The switch may include: a first switching element configured to supply the reference voltage to the reference voltage line in response to the first selection signal; and a second switching element configured to supply the power voltage to the reference voltage line in response to the second selection signal.

The second switching element may receive the power voltage through the voltage line.

In an embodiment of the inventive concept, a display device comprises a display panel including a pixel, a voltage line supplying a first power voltage to the pixel, and a reference voltage line supplying a second power voltage to the pixel.

The pixel comprises a first transistor connected between the anode of the light emitting element and the voltage line, a second transistor connected between a data line and the first transistor, a third transistor connected between the reference voltage line and the second transistor, and a capacitor connected between the first transistor and the third transistor.

The display panel operates in a first mode and a second mode, and the first power voltage has a first voltage level in the first and second modes. The second power voltage has a second voltage level in the first mode and has the first voltage level in the second mode, and the first voltage level is different from the second voltage level.

BRIEF DESCRIPTION OF THE FIGURES

The accompanying drawings are included to provide a further understanding of the inventive concept, and are incorporated in and constitute a part of the present disclosure. The drawings illustrate exemplary embodiments of the inventive concept and, together with the description, serve to explain principles of the inventive concept. In the drawings.

DETAILED DESCRIPTION

Figure 1:
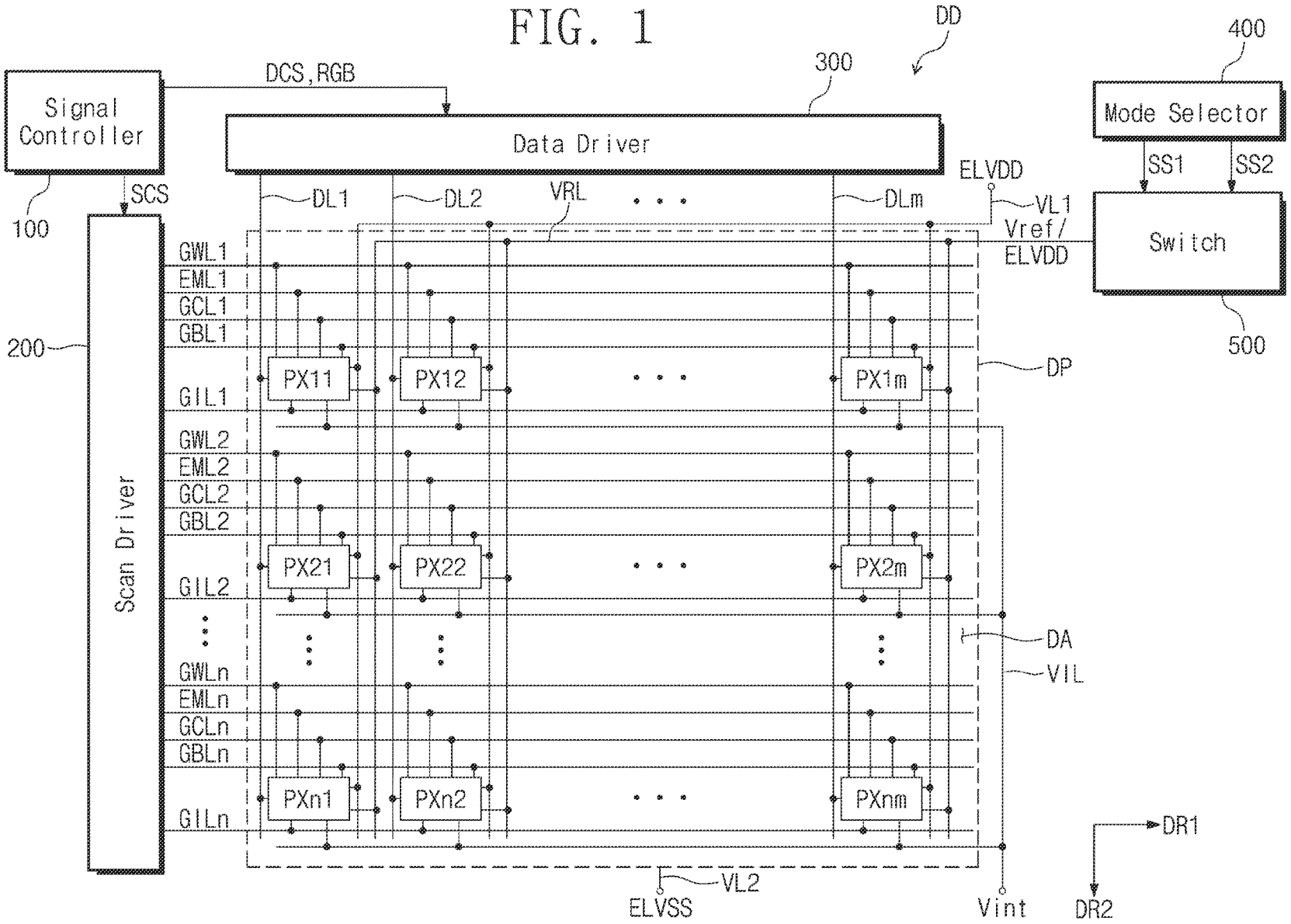
FIG. 1 is a block diagram illustrating a display device according to an embodiment of the inventive concept.

In present disclosure, a component (or, an area, a layer, a part, etc.) being referred to as being "on", "connected to" or "combined to" another component means that the component may be directly on, connected to, or combined to the other component or a third component may be present therebetween.

Like reference numerals refer to like elements. Additionally, in the drawings, thicknesses, proportions, and dimensions of components may be exaggerated for effective description.

"And/or" includes all of one or more combinations defined by related components.

It will be understood that the terms "first" and "second" are used herein to describe various components, but these components should not be limited by these terms. The above terms are used only to distinguish one component from another component. For example, a first component may be referred to as a second component and vice versa without departing from the scope of the inventive concept. The terms of a singular form may include a plural form unless otherwise expressly specified.

In addition, terms such as "below," "a lower side," "on," and "an upper side" are used to describe a relationship of configurations shown in the drawing. It is understood that these terms are described as a relative relationship based on a direction shown in the drawing.

Unless otherwise defined, terms (including technical and scientific terms) used herein may have the same meaning as terms commonly understood by those skilled in the art to which the present disclosure belongs. In general, the terms defined in the dictionary should be considered to have the same meaning as the contextual meaning of the related art, and, unless clearly expressly defined herein, should not be understood abnormally or as having an excessively formal meaning.

In various embodiments of the inventive concept, the term "include," "comprise," "including," or "comprising," specifies a property, a region, a fixed number, a step, a process, an element, and/or a component, but does not exclude other properties, regions, fixed numbers, steps, processes, elements, and/or components.

Hereinafter, various embodiments of the inventive concept will be described with reference to the drawings.

FIG. 1 is a block diagram illustrating a display device according to an embodiment of the inventive concept.

Referring to FIG. 1, a display device DD includes a display panel DP, a signal controller 100, a scan driver 200, a data driver 300, a mode selector 400, and a switch 500. The display device DD may be activated in response to an electrical signal. The display device DD may include various embodiments. For example, the display device DD may include a computer, a personal computer (PC), a tablet PC, a laptop computer, a television, and a smart phone.

The signal controller 100 may receive input image signals (not shown), convert a data format of the input image signals, and generate image data signals RGB that are suitable for an interface with the data driver 300. The signal controller 100 may generate a scan control signal SCS for controlling the driving of the scan driver 200 and a data control signal DCS for controlling the driving of the data driver 300.

The scan driver 200 may receive the scan control signal SCS from the signal controller 100. The scan control signal SCS may include a start signal that indicates a start of an operation of the scan driver 200 and a clock signal. The scan driver 200 may generate a plurality of scan signals, and sequentially outputs the plurality of scan signals to scan lines as described later in further details. Also, the scan driver 200 may generate a plurality of light emission control signals in response to the scan control signal SCS, and output them to a plurality of light emission control lines EML1 to EMLn (n is an integer greater than one).

In an exemplary embodiment of the inventive concept, the scan driver 200 may include an initialization scan driver, a compensation scan driver, a write scan driver, and a black scan driver. The initialization scan driver may output initialization scan signals to initialization scan lines GIL1 to GILn of the display panel DP, and the compensation scan driver may output compensation scan signals to compensation scan lines GCL1 to GCLn of the display panel DP. The initialization scan driver and the compensation scan driver may be implemented in independent circuits or may be integrated into one circuit. In a case where the initialization scan driver and the compensation scan driver are integrated into one circuit, the initialization scan signals may be referred to as previous scan signals, and the compensation scan signals may be referred to as current scan signals.

The write scan driver may output write scan signals to write scan lines GWL1 to GWLn of the display panel DP, and the black scan driver may output black scan signals to black scan lines GBL1 to GBLn of the display panel DP. The write scan driver and the black scan driver may be implemented in independent circuits or may be integrated into one circuit. In a case where the write scan driver and the black scan driver are integrated into one circuit, the write scan signals may be referred to as current scan signals, and the black scan signals may be referred to as next scan signals.

Although FIG. 1 illustrates that a plurality of scan signals and a plurality of light emission control signals are outputted from the scan driver 200, the inventive concept is not limited thereto. In another embodiment of the inventive concept, the scan driver 200 may include one or more scan drivers outputting the plurality of scan signals and a light emission driver outputting the plurality of light emission control signals that is separate from the one or more scan drivers.

The data driver 300 may receive the data control signal DCS and the image data signals RGB from the signal controller 100. The data driver 300 may convert the image data signals RGB into data signals, and output the data signals to a plurality of data lines DL1 to DLm (m is an integer greater than one). The data signals may be analog voltages corresponding to gradation values of the image data signals RGB.

The display device DD further includes a voltage generator (not shown) for generating voltages for the operation of the display device DD. In this embodiment, the voltage generator may generate a first power voltage ELVDD, a second power voltage ELVSS, a reference voltage Vref, and an initialization voltage Vint.

The display panel DP may generate an image IM. The display panel DP includes the scan lines, the data lines DL1 to DLm, and pixels PX11 to PXnm. The scan lines may extend in a first direction DR1 and may be spaced apart from each other in a second direction DR2. The data lines DL1 to DLm may extend in the second direction DR2 and may be spaced apart from each other in the first direction DR1. As an example of the inventive concept, the scan lines include the initialization scan lines GIL1 to GILn, the compensation scan lines GCL1 to GCLn, the write scan lines GWL1 to GWLn, and the black scan lines GBL1 to GBLn.

Each of the pixels PX11 to PXnm is connected to a corresponding data line and corresponding scan lines. For example, the first pixel PX11 among the pixels PX11 to PXnm is connected to a first data line DL1, a first initialization scan line GILL a first compensation scan line GCL1, a first write scan line GWL1, and a first black scan line GBL1. The last pixel PXnm among the pixels PX11 to PXnm is connected to an m-th data line DLm, an n-th initialization scan line GILn, an n-th compensation scan line GCLn, an n-th write scan line GWLn, and an n-th black scan line GBLn. As an example of the inventive concept, each of the pixels PX11 to PXnm may be electrically connected to four different scan lines.

The display panel DP may receive the first power voltage ELVDD, the second power voltage ELVSS, and the initialization voltage Vint. The display panel DP may include a first voltage line VL1 that transmits the first power voltage ELVDD, a second voltage line VL2 that transmits the second power voltage ELVSS, and an initialization voltage line VIL that transmits the initialization voltage Vint. Each of the pixels PX11 to PXnm may be electrically connected to the first voltage line VL1, the second voltage line VL2, and the initialization voltage line VIL and receive the first power voltage ELVDD, the second power voltage ELVSS, and the initialization voltage Vint. Each of the pixels PX11 to PXnm may be electrically connected to a reference voltage line VRL that transmits the reference voltage Vref or the first power voltage ELVDD.

The switch 500 may select one of the reference voltage Vref and the first power voltage ELVDD and apply it to the reference voltage line VRL. The mode selector 400 may output one of a first selection signal SS1 and a second selection signal SS2 according to an operation mode of the display panel DP. For example, when the display panel DP operates in a first mode, the mode selector 400 may output the first selection signal SS1, and when the display panel DP operates in a second mode, the mode selector 400 may output the second selection signal SS2. The operation mode of the display panel DP may be selected by a user. As an example of the inventive concept, the first mode may be a document working mode, and the second mode may be a video viewing mode. When the user selects one of the first and second modes, the mode selector 400 may provide a selection signal corresponding to the selected mode to the switch 500.

The switch 500 may select one of the reference voltage Vref and the first power voltage ELVDD in response to the selection signal received from the mode selector 400. For example, when the first selection signal SS1 is received, the switch 500 outputs the reference voltage Vref to the reference voltage line VRL in response to the first selection signal SS1, and when the second selection signal SS2 is received, the switch 500 outputs the first power voltage ELVDD to the reference voltage line VRL in response to the second selection signal SS2.

Figure 2:
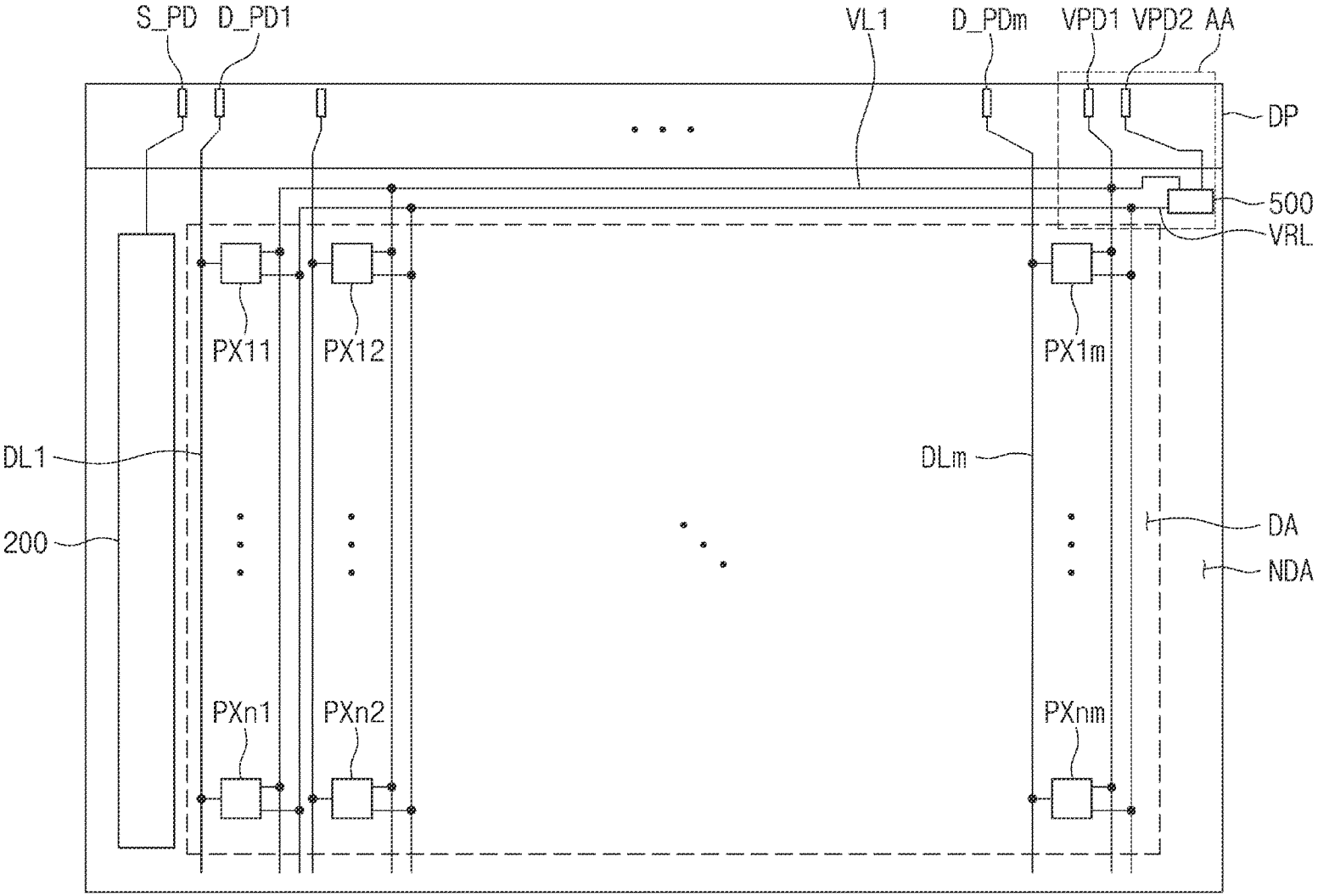
FIG. 2 is a plan view illustrating a display panel according to an embodiment of the inventive concept.
Figure 3:
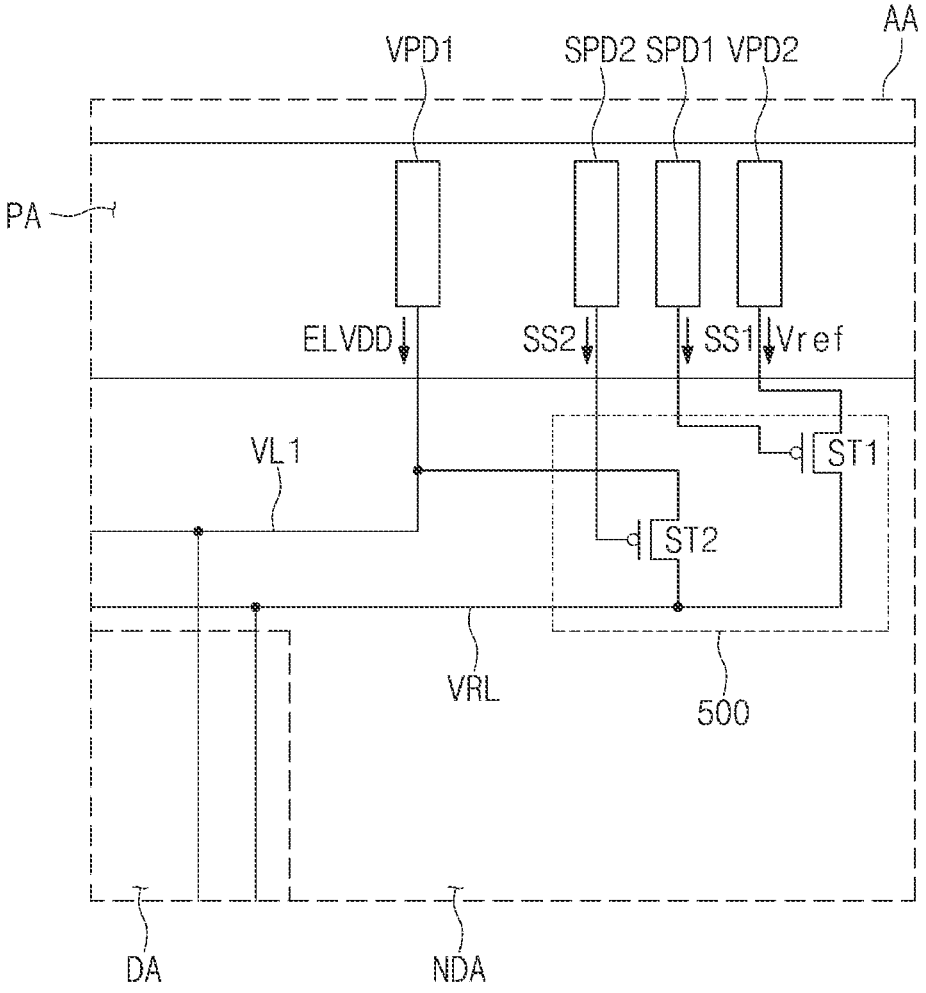
FIG. 3 is an enlarged plan view of a portion AA shown in FIG. 2.

FIG. 2 is a plan view of the display panel DP according to an exemplary embodiment of the inventive concept, and FIG. 3 is an enlarged plan view of a portion AA shown in FIG. 2.

Referring to FIG. 2, the display panel DP may be divided into a display area DA and a non-display area NDA. The plurality of pixels PX11 to PXnm may be arranged in an n-by-m matrix form in the display area DA. The data lines DL1 to DLm and the scan lines may be disposed in the display area DA. The scan driver 200 connected to the scan lines may be disposed in the non-display area NDA of the display panel DP. For example, the scan driver 200 may be provided in the non-display area NDA through a thin film process in which the plurality of pixels PX11 to PXnm is formed in the display area DA. The plurality of pixels PX11 to PXnm and the scan driver 200 may be simultaneously formed through the same thin film process.

A pad area PA may be provided outside the non-display area NDA of the display panel DP. Data pads D_PD1 to D_PDm connected to the data lines DL1 to DLm may be disposed in the pad area PA. Scan pads S_PD for supplying the scan control signal SCS (shown in FIG. 1) to the scan driver 200 may be disposed in the pad area PA.

The display panel DP may receive signals from an external device through pads disposed in the pad area PA. Although not illustrated in the drawings, a flexible circuit film may be coupled to the pad area PA of the display panel DP.

A first power pad VPD1 connected to the first voltage line VL1 and a second power pad VPD2 connected to the reference voltage line VRL may be further disposed in the pad area PA of the display panel DP. Although not shown in FIG. 2, a third power pad connected to the second power line VL2 (shown in FIG. 1) and a fourth power pad connected to the initialization voltage line VIL (shown in FIG. 1) may be further disposed in the pad area PA of the display panel DP.

The switch 500 may be disposed in the non-display area NDA of the display panel DP. The switch 500 may be disposed between the second power pad VPD2 and the reference voltage line VRL. The switch 500 may be provided in the non-display area NDA through the thin film process in which pixels PX11 to PXnm are formed in the display area DA. The plurality of pixels PX11 to PXnm and the switch 500 may be simultaneously formed through the same thin film process.

As shown in FIG. 3, the switch 500 may include a first switching element ST1 and a second switching element ST2. The first switching element ST1 may receive the first selection signal SS1 from the mode selector 400 (shown in FIG. 1), and the second switching element ST2 may receive the second selection signal SS2 from the mode selector 400.

The first switching element ST1 includes a first electrode that is electrically connected to the second voltage pad VPD2, a second electrode that is electrically connected to a first selection signal pad SPD1, and a third electrode that is electrically connected to the reference voltage line VRL. The second switching element ST2 includes a first electrode that is electrically connected to the first voltage pad VPD1, a second electrode that is electrically connected to a second selection signal pad SPD2, and a third electrode electrically connected to the reference voltage line VRL.

The first selection signal pad SPD1 that provides the first selection signal SS1 to the second electrode of the first switching element ST1 and the second selection signal pad SPD2 that provides the second selection signal SS2 to the second electrode of the second switching element ST2 may be disposed in the pad area PA of the display panel DP. The first switching element ST1 receives the first selection signal SS1 through the first selection signal pad SPD1, and the second switching element ST2 receives the second selection signal SS2 through the second selection signal pad SPD2.

In the first mode, when the first selection signal SS1 from the mode selector 400 is supplied to the switch 500, the first switching element ST1 is turned on, and the second switching element ST2 is turned off. The reference voltage Vref may be supplied to the reference voltage line VRL through the turned-on first switching element ST1. Meanwhile, the supply of the first power voltage ELVDD to the reference voltage line VRL may be blocked by the turned-off second switching element ST2. Accordingly, in the first mode, the pixels PX11 to PXnm (shown in FIG. 2) of the display panel DP may receive the reference voltage Vref through the reference voltage line VRL.

Meanwhile, in the second mode, when the second selection signal SS2 from the mode selector 400 is supplied to the switch 500, the second switching element ST2 is turned on, and the first switching element ST1 is turned off. The first power voltage ELVDD may be supplied to the reference voltage line VRL through the turned-on second switching element ST2. Meanwhile, the supply of the reference voltage Vref to the reference voltage line VRL may be blocked by the turned-off first switching element ST1. Accordingly, in the second mode, the pixels PX11 to PXnm of the display panel DP may receive the first power voltage ELVDD through the reference voltage line VRL.

The second switching element ST2 may receive the first power voltage ELVDD through the first voltage line VL1 provided on the display panel DP. The plurality of pixels PX11 to PXnm and the second switching element ST2 may be commonly connected to the first voltage line VL1.

The display device DD (shown in FIG. 1) may selectively provide the reference voltage Vref or the first power voltage ELVDD to the reference voltage line VRL according to an operation mode of the display panel DP using the switch 500.

Figure 4:
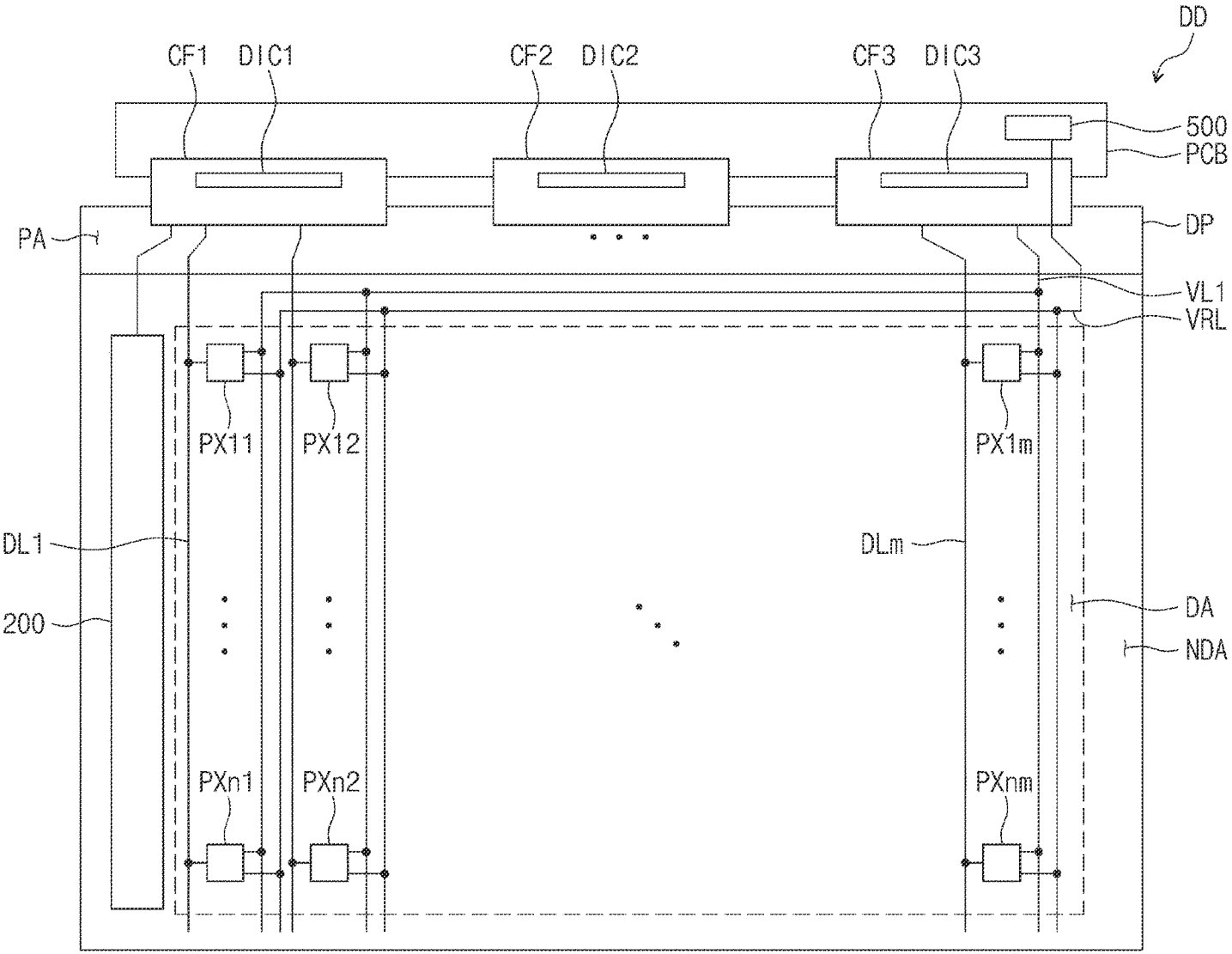
FIG. 4 is a plan view illustrating a display device according to an embodiment of the inventive concept.

FIG. 4 is a plan view illustrating the display device DD according to an embodiment of the inventive concept. The same reference numerals are used for components identical to the components shown in FIGS. 2 and 3, and the detailed description thereof that is redundant will be omitted.

Referring to FIG. 4, the display device DD includes the display panel DP, a plurality of flexible circuit films CF1 to CF3, and a printed circuit board PCB. The flexible circuit films CF1 to CF3 may provide various electrical signals to the display panel DP for driving the display panel DP. The electrical signals may be generated from the flexible circuit films CF1 to CF3 or may be received from the printed circuit board PCB. The printed circuit board PCB may include various driving circuits that generate the electrical signals for driving the display panel DP.

The flexible circuit films CF1 to CF3 may be coupled to the pad area PA of the display panel DP. The data pads D_DP1 to D_DPm (shown in FIG. 2) connected to the data lines DL1 to DLm may be disposed in the pad area PA. The scan pads S_PD (shown in FIG. 2) for supplying the scan control signal SCS (shown in FIG. 1) to the scan driver 200 may be disposed in the pad area PA.

The display panel DP may receive the electrical signals from the flexible circuit films CF1 to CF3 through the pads disposed in the pad area PA.

The data driver 300 (shown in FIG. 1) may be implemented in a chip, and it may be mounted on the flexible circuit films CF1 to CF3. As an example of the inventive concept, the data driver 300 may include a plurality of driving chips DIC1 to DIC3. The plurality of driving chips DIC1 to DIC3 may be mounted on the flexible circuit films CF1 to CF3. As another example, the plurality of driving chips DIC1 to DIC3 may be mounted on the display panel DP.

The flexible circuit films CF1 to CF3 may be combined with the printed circuit board PCB to be electrically connected to the display panel DP. As an example of the inventive concept, the switch 500 may be provided on the printed circuit board PCB. In this case, the switch 500 may be electrically connected to the reference voltage line VRL of the display panel DP through one of the flexible circuit films CF1 to CF3. The switch 500 may include the first and second switching elements ST1 and ST2 (shown in FIG. 3) for receiving the first and second selection signals SS1 and SS2 (shown in FIG. 3), respectively. In response to one of the first and second selection signals SS1 and SS2, the switch 500 may select one of the reference voltage Vref and the first power voltage ELVDD and provide the selected one to the reference voltage line VRL.

FIG. 2 illustrates an embodiment in which the switch 500 is provided on the display panel DP, and FIG. 4 illustrates an embodiment in which the switch 500 is provided on the printed circuit board PCB, but the inventive concept is not limited thereto. As another example, the switch 500 may be provided on at least one of the driving chips DIC1 to DIC3.

Figure 5:
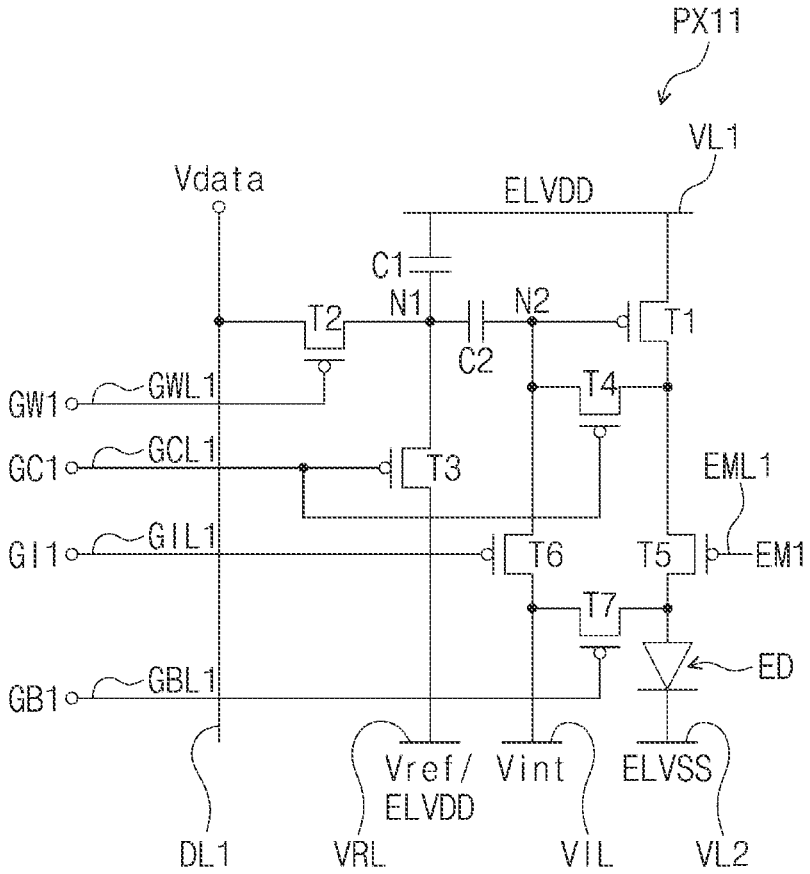
FIG. 5 is a circuit diagram of a pixel according to an embodiment of the inventive concept.

FIG. 5 is a circuit diagram of a pixel according to an embodiment of the inventive concept. Each of the pixels PX11 to PXnm illustrated in FIG. 2 may have the same configuration. As a representative example, FIG. 5 illustrates the configuration of the first pixel PX11, and description of the configuration of the remaining pixels PX12 to PXnm will be omitted.

Referring to FIG. 5, the first pixel PX11 may include a plurality of transistors T1 to T7, two capacitors C1 and C2, and a light emitting element ED. The plurality of transistors T1 to T7 and the two capacitors C1 and C2 may control an amount of current flowing through the light emitting element ED in response to the data signal and the scan signals.

Each of the plurality of transistors T1 to T7 may include an input electrode (or a source electrode), an output electrode (or a drain electrode), and a control electrode (or a gate electrode). For convenience, an input electrode, a control electrode, and an output electrode may be referred to as a first electrode, a second electrode, and a third electrode, respectively. Further, the plurality of transistors T1 to T7 are referred to as first to seventh transistors T1 to T7, and the two capacitors C1 and C2 are referred to as first and second capacitors C1 and C2.

The first transistor T1 may be connected between the first voltage line VL1 and the light emitting element ED. The first transistor T1 may include a first electrode electrically connected to the first voltage line VL1, a second electrode connected to a second node N2, and a third electrode electrically connected to the light emitting element ED. The first transistor T1 may receive the first power voltage ELVDD through the first voltage line VL1. The third electrode of the first transistor T1 may be electrically connected to an anode of the light emitting element ED via the fifth transistor T5. The first transistor T1 may control an amount of current flowing through the light emitting element ED in response to a voltage applied to the second electrode of the first transistor T1.

The second transistor T2 may be connected between the first data line DL1 and a first node N1. The second transistor T2 may include a first electrode connected to the first data line DL1, a second electrode connected to the first write scan line GWL1, and a third electrode connected to the first node N1. During a data write period, the second transistor T2 may be turned on in response to a first write scan signal GW1 provided to the first write scan line GWL1, and the first data line DL1 and the first node N1 may be electrically connected by the turned-on second transistor T2. That is, a data voltage Vdata applied to the first data line DL1 may be transmitted to the first node N1 through the turned-on second transistor T2 during the data write period.

The first capacitor C1 may be electrically connected between the first voltage line VL1 and the first node N1, and the second capacitor C2 may be electrically connected between the first node N1 and the second electrode of the first transistor T1. The first capacitor C1 may include a first electrode electrically connected to the first voltage line VL1 and a second electrode electrically connected to the first node N1, and the second capacitor C2 includes a first electrode electrically connected to the first node N1 and a second electrode electrically connected to the second node N2.

The third transistor T3 may be electrically connected between the first node N1 and the reference voltage line VRL. The third transistor T3 may include a first electrode connected to the reference voltage line VRL, a second electrode electrically connected to the first compensation scan line GCL1, and a third electrode electrically connected to the first node N1. The reference voltage line VRL may provide the reference voltage Vref or the first power voltage ELVDD according to an operation mode of the display panel DP. During a compensation period, the third transistor T3 may be turned on in response to a first compensation scan signal GC1 provided to the first compensation scan line GCL1, and the reference voltage line VRL and the first node N1 may be electrically connected by the turned-on third transistor T3. That is, the reference voltage Vref or the first power voltage ELVDD may be applied to the first node N1 during the compensation period.

The fourth transistor T4 may be electrically connected between the second electrode of the first transistor T1 (or the second node N2) and the third electrode of the first transistor T1. The fourth transistor T4 may include a first electrode electrically connected to the third electrode of the first transistor T1, a second electrode electrically connected to the first compensation scan line GCL1, and a third electrode electrically connected to the second node N2. During the compensation period, the fourth transistor T4 may be turned on in response to the first compensation scan signal GC1 provided to the first compensation scan line GCL1. That is, the first transistor T1 may be diode-connected by the fourth transistor T4 that is turned on during the compensation period. As an example of the inventive concept, the second electrodes of the third and fourth transistors T3 and T4 are commonly connected to the first compensation scan line GCL1, but the inventive concept is not limited thereto. For example, the second electrode of the third transistor T3 and the second electrode of the fourth transistor T4 may be connected to different compensation scan lines and receive different compensation scan signals.

The fifth transistor T5 may be electrically connected between the third electrode of the first transistor T1 and the anode of the light emitting element ED. The fifth transistor T5 may include a first electrode connected to the third electrode of the first transistor T1, a second electrode electrically connected to a first light emission control line EML1, and a third electrode electrically connected to the anode of the light emitting element ED. During a light emission period, the fifth transistor T5 may be turned on by a first light emission control signal EM1 provided to the first light emission control line EML1.

The sixth transistor T6 may be electrically connected between the second node N2 and the initialization voltage line VIL. The sixth transistor T6 may include a first electrode electrically connected to the second node N2, a second electrode electrically connected to the first initialization scan line GILL and a third electrode electrically connected to the initialization voltage line VIL. The initialization voltage Vint may be applied to the initialization voltage line VIL. During an initialization period, the sixth transistor T6 may be turned on in response to a first initialization scan signal GI1 provided to the first initialization scan line GILL That is, the second node N2 may be initialized to the initialization voltage Vint by the sixth transistor T6 that is turned on during the initialization period.

The seventh transistor T7 may be electrically connected between the initialization voltage line VIL and the anode of the light emitting element LD. The seventh transistor T7 may include a first electrode connected to the anode of the light emitting element ED, a second electrode electrically connected to the first black scan line GBL1, and a third electrode connected to the initialization voltage line VIL. During a black period, the seventh transistor T7 may be turned on in response to a first black scan signal GB1 that is provided to the first black scan line GBL1. That is, the anode of the light emitting element ED may be initialized to the initialization voltage Vint by the turned-on seventh transistor T7 during the black period.

In FIG. 5, the first to seventh transistors T1 to T7 may be p-type metal oxide semiconductor (PMOS) transistors are shown, but the present disclosure is not limited thereto. In another embodiment of the inventive concept, some or all of the first to seventh transistors T1 to T7 may be configured as n-type metal oxide semiconductor (NMOS) transistors.

The light emitting element ED may be electrically connected between the fifth transistor T5 and the second voltage line VL2. The anode of the light emitting element ED may be connected to the third electrode of the fifth transistor T5, and a cathode of the light emitting element ED may be connected to the second voltage line VL2. The second power voltage ELVSS may be applied to the second voltage line VL2. The second power voltage ELVSS may have a lower level than the first power voltage ELVDD. Accordingly, the light emitting element ED may emit light according to a voltage difference between a voltage transmitted through the fifth transistor T5 and the second power voltage ELVSS.

Figure 6A:
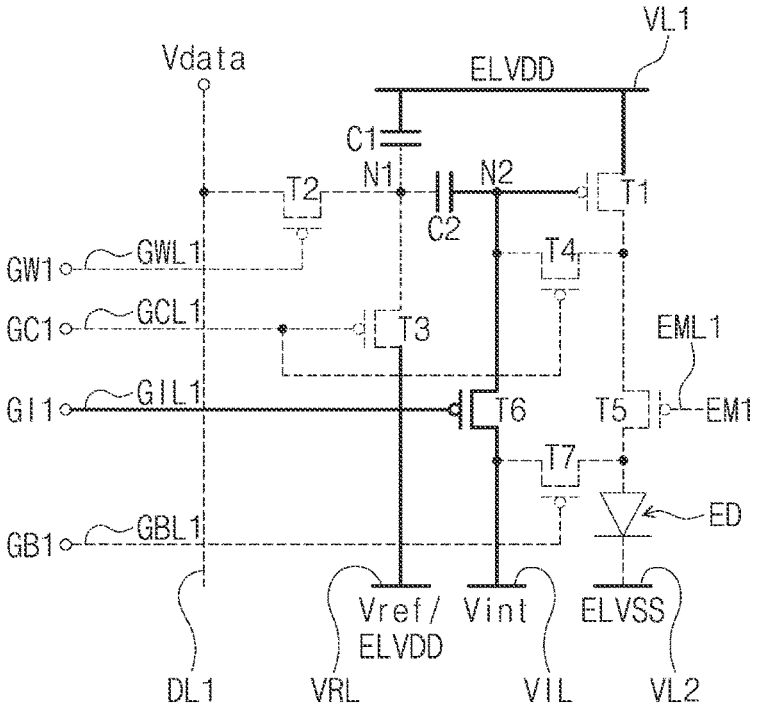
FIG. 6A is a circuit diagram showing the operation of a pixel during an initialization period.
Figure 6B:
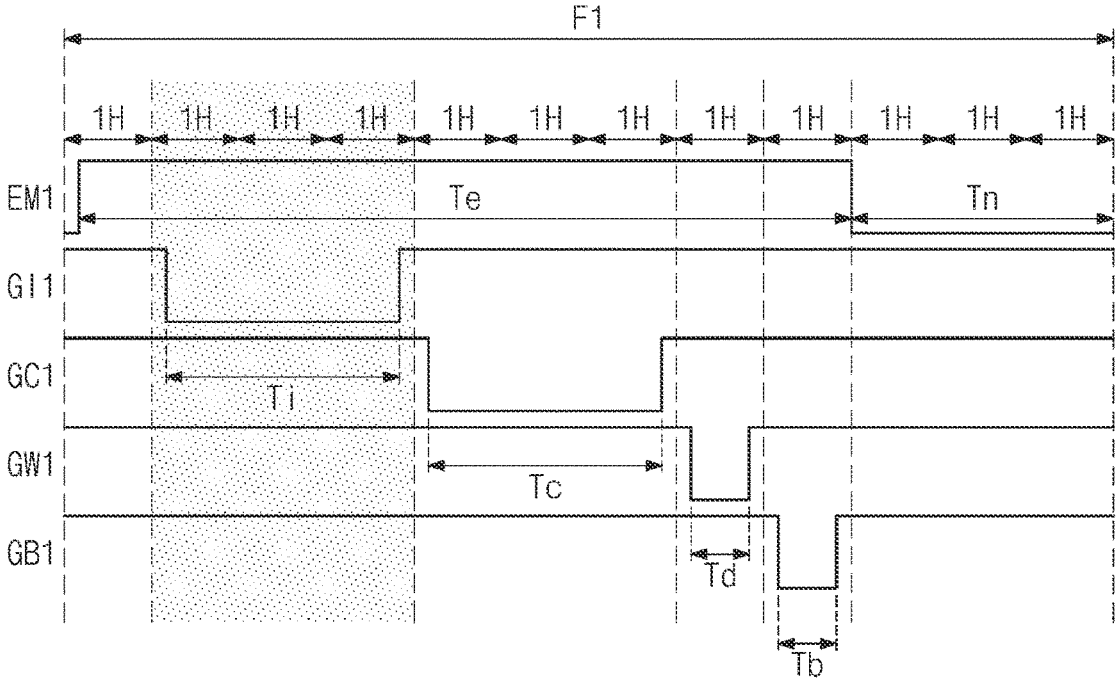
FIG. 6B is a diagram showing waveforms of signals during the initialization period of FIG. 6A.

FIG. 6A is a circuit diagram showing the operation of a pixel during the initialization period, and FIG. 6B is a diagram showing waveforms of signals during the initialization period of FIG. 6A.

The display device DD (shown in FIG. 1) displays a unit image for each frame period. Each of the pixels PX11 to PXnm illustrated in FIG. 1 may receive a corresponding data signal for each frame period.

FIG. 6B illustrates one frame period F1 among a plurality of frame periods. Referring to FIG. 6B, the operation of the first pixel PX11 in the frame period F1 will be described for the purpose of explanation, but it is noted that other pixels PX12 to PXnm may operate similarly to the first pixel PX11 in the frame period F1, and also, pixels PX11 to PXnm may operate similarly in other frame periods.

The frame period F1 may be divided into a non-light emission period Te and a light emission period Tn according to the first light emission control signal EM1. During the non-light emission period Te, the first light emission control signal EM1 may have a high level, and during the light emission period Tn, the first light emission control signal EM1 may have a low level. However, this is in a case where the fifth transistor T1 receiving the first light emission control signal EM1 is a PMOS transistor. In a case where the fifth transistor T1 is an NMOS transistor, during the non-light emission period Te, the first light emission control signal EM1 may have the low level, and during the light emission period Tn, the first light emission control signal EM1 may have the high level.

The first initialization scan signal GI1 may be activated during the non-light emission period Te. In the present embodiment, the signals shown in FIG. 6B are described as being activated when they have a low level, but the inventive concept is not limited thereto. Here, the first initialization scan signal GI1 may have a low level during the activation period and a high level during the deactivation period. The low level of the signals illustrated in FIG. 6B may be a turn-on voltage of the transistor to which the signals are applied in the present example where the transistor is a PMOS transistor. However, as another example where the transistor is an NMOS transistor, the high level of the signals illustrated in FIG. 6B may be a turn-on voltage of the transistor to which the signals are applied.

The activation period of the first initialization scan signal GI1 may be referred to as an initialization period T1. The first initialization scan signal GI1 may be applied to the sixth transistor T6 through the first initialization scan line GILL and during the initialization period T1 in which the first initialization scan signal GI1 is activated, the sixth transistor T6 is turned on. During the initialization period T1, the potential of the second node N2 may be initialized to the initialization voltage Vint by the turned-on sixth transistor T6.

The first compensation scan signal GC1, the first write scan signal GW1, and the first black scan signal GB1 may also be subsequently activated during the non-light emission period Te after the initialization period T1. That is, during the initialization period T1, each of the first compensation scan signal GC1, the first write scan signal GW1 and the first black scan signal GB1 may be deactivated, and only the first initialization scan signal GI1 may be activated. Here, an activation period of the first compensation scan signal GC1 may be referred to as a compensation period Tc, an activation period of the first write scan signal GW1 may be referred to as a data write period Td, and an activation period of the first black scan signal GB1 may be referred to as a black period Tb.

As shown in FIG. 6B, the initialization period T1, the compensation period Tc, the data write period Td, and the black period Tb may be included in the non-light emission period Te without overlapping each other. In addition, each of the initialization period T1, the compensation period Tc, the data write period Td, and the black period Tb may have the same duration or different durations. As an example of the inventive concept, the duration of the initialization period T1 may be longer than the duration of the data write period Td. For example, the duration of the data write period Td may be approximately 1H, the initialization period T1 may have a duration of about 3H that is three times longer than the period of the data write period Td. In addition, the duration of the compensation period Tc may be longer than the duration of the data write period Td, and may be the same as the duration of the initialization period T1. The duration of the black period Tb may be the same as the duration of the data write period Td. However, it is noted that this is only an example, and the duration of each period is not limited to this example and may be variously modified without deviating from the scope of the present disclosure.

The first initialization scan signal GI1 may be generated first in the non-light emission period Te. That is, the initialization period T1 may precede the compensation period Tc, the data write period Td, and the black period Tb. When the first initialization scan signal GI1 is deactivated, the initialization period T1 ends, and the first compensation scan signal GC1 may be activated.

Figure 7A:
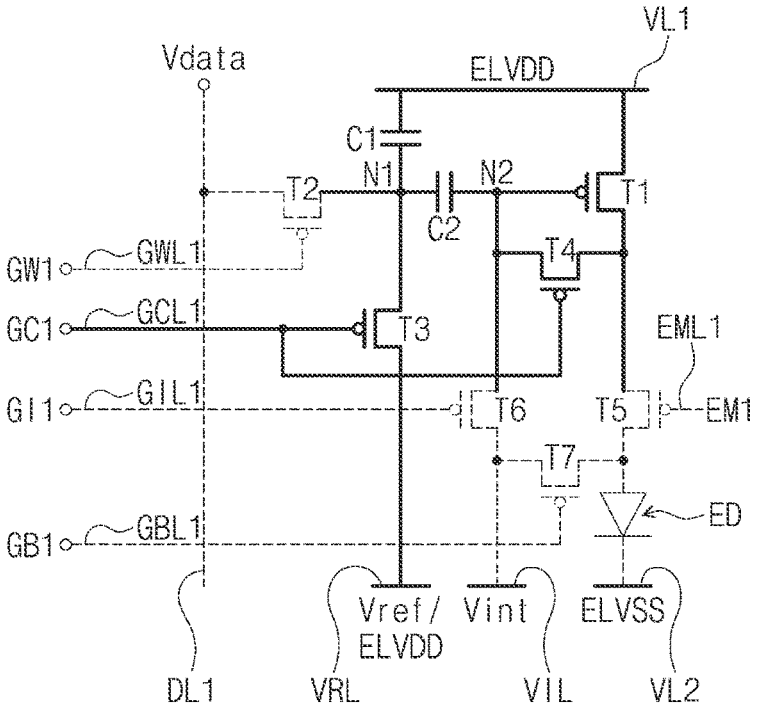
FIG. 7A is a circuit diagram showing the operation of a pixel during a compensation period.
Figure 7B:
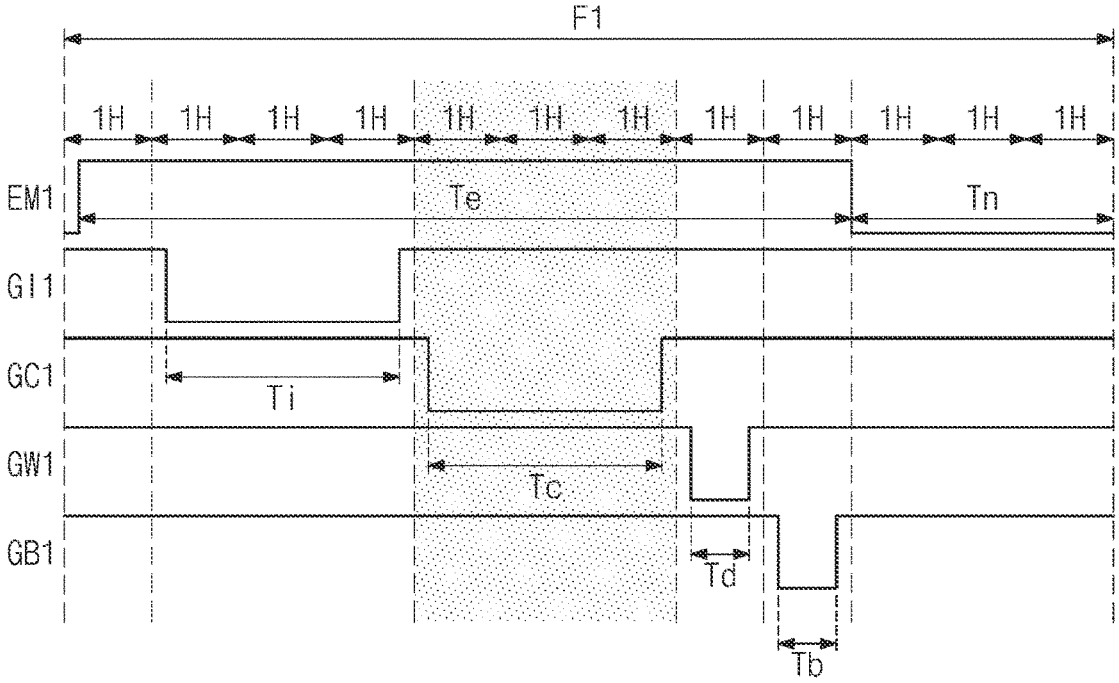
FIG. 7B is a diagram showing waveforms of signals during the compensation period of FIG. 7A.

FIG. 7A is a circuit diagram showing the operation of a pixel during the compensation period, and FIG. 7B is a diagram showing waveforms of signals during the compensation period of FIG. 7A.

Referring to FIGS. 7A and 7B, the first compensation scan signal GC1 may be activated during the compensation period Tc within the non-light emission period Te. Here, the first compensation scan signal GC1 may have a low level during the compensation period Tc and a high level during the deactivation period.

The first compensation scan signal GC1 may be applied to the fourth transistor T4 through the first compensation scan line GCL1, and during the compensation period Tc in which the first compensation scan signal GC1 is activated, the fourth transistor T4 is turned on. During the compensation period Tc, the first transistor T1 is diode-connected and biased forward by the turned-on fourth transistor T4. Then, a compensation voltage "ELVDD-Vth" that corresponds to the first power voltage ELVDD reduced by a threshold voltage Vth of the first transistor T1 may be applied to the second node N2. That is, the potential of the second node N2 may be compensated by the compensation voltage "ELVDD-Vth" during the compensation period Tc.

In addition, since the first compensation scan signal GC1 is supplied to the third transistor T3 through the first compensation scan line GCL1 during the compensation period Tc, the third transistor T3 is turned on. The reference voltage Vref or the first power voltage ELVDD may be applied to the first node N1 through the turned-on third transistor T3. That is, the potential of the first node N1 may be either the reference voltage Vref "Vref" or the first power voltage "ELVDD".

In the non-light emission period Te, the compensation period Tc may precede the data write period Td and the black period Tb. After the first compensation scan signal GC1 is deactivated, the compensation period Tc ends, and the first write scan signal GW1 may be activated.

Figure 8A:
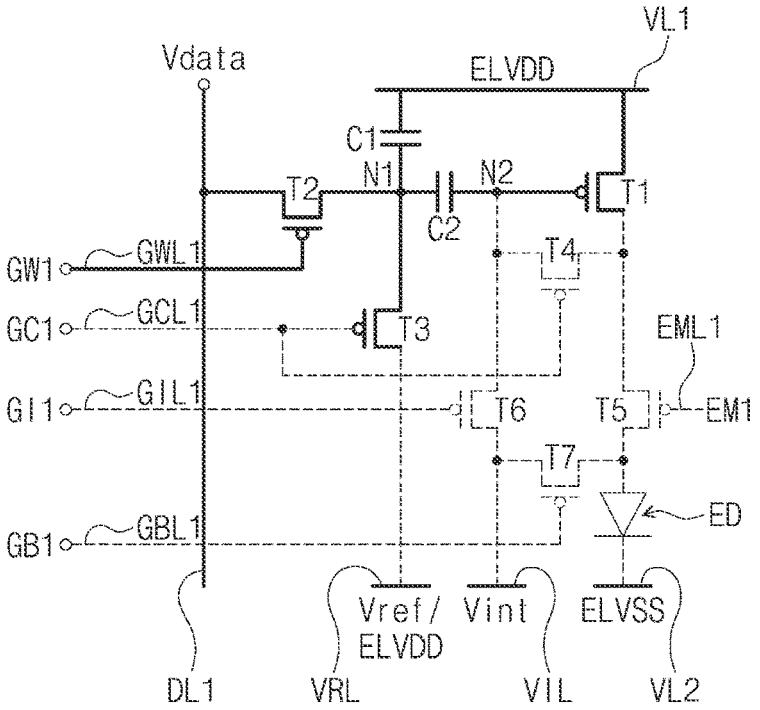
FIG. 8A is a circuit diagram showing the operation of a pixel during a data write period.
Figure 8B:
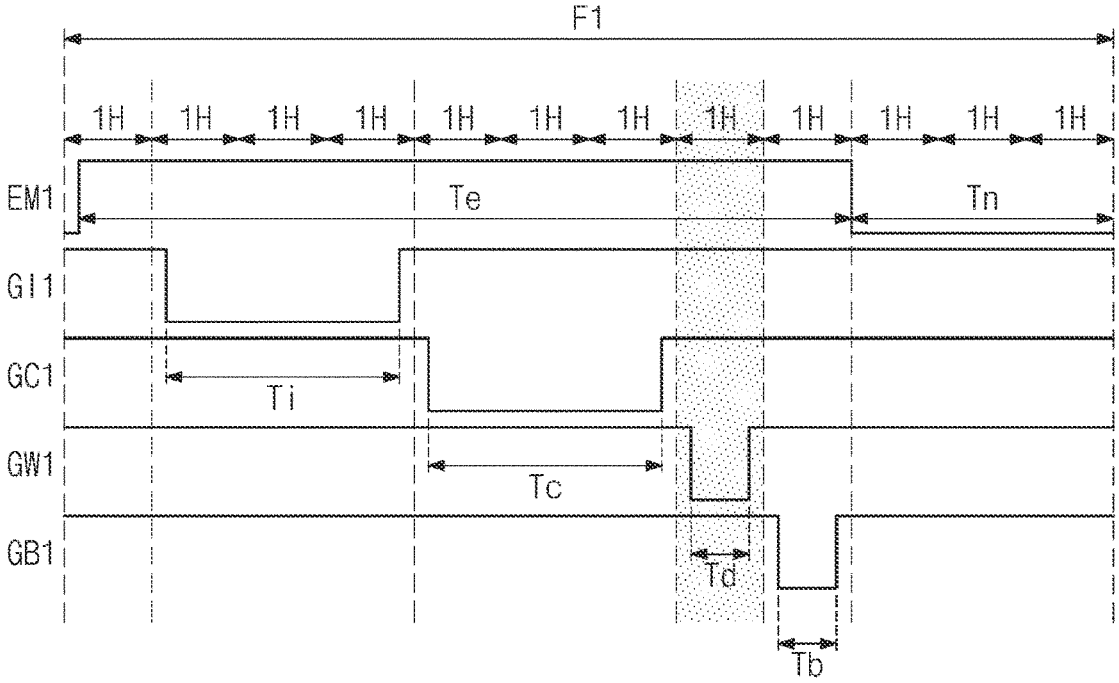
FIG. 8B is a diagram showing waveforms of signals during the data write period of FIG. 8A.

FIG. 8A is a circuit diagram showing operation of a pixel during the data write period, and FIG. 8B is a diagram showing waveforms of signals during the data write period of FIG. 8A.

Referring to FIGS. 8A and 8B, the first write scan signal GW1 may be activated during the data write period Td within the non-light emission period Te. Here, the first write scan signal GW1 may have a low level during the data write period Td and a high level during the deactivation period.

The first write scan signal GW1 may be applied to the second transistor T2 through the first write scan line GWL1, and during the data write period Td in which the first write scan signal GW1 is activated, the second transistor T2 is turned on. During the data write period Td, the data voltage Vdata supplied to the first data line DL1 may be applied to the first node N1 through the turned-on second transistor T2. This changes the potential of the first node N1 from the reference voltage Vref or the first power voltage ELVDD to the data voltage Vdata. When the reference voltage Vref is supplied to the reference voltage line VRL during the compensation period Tc in the first mode, the amount of a potential change of the first node N1 corresponds to "Vdata−Vref". However, when the first power voltage ELVDD is supplied to the reference voltage line VRL during the compensation period Tc in the second mode, the amount of the potential change of the first node N1 corresponds to "Vdata-ELVDD".

During the data write period Td, when the potential of the first node N1 changes from the reference voltage Vref or the first power voltage ELVDD to the data voltage Vdata, the potential of the second node N2 is changed from the compensation voltage "ELVDD-Vth" to a first gate voltage Vg1 or a second gate voltage Vg2 by the coupling of the second capacitor C2. That is, in the first mode in which the reference voltage Vref is supplied to the reference voltage line VRL during the compensation period Tc, the potential of the second node N2 is changed to the first gate voltage Vg1 that corresponds to "Vg1=ELVDD−Vth+Vdata−Vref". Meanwhile, in the second mode in which the first power voltage ELVDD is supplied to the reference voltage line VRL during the compensation period Tc, the potential of the second node N2 is changed to the second gate voltage Vg2 that corresponds to "Vg2=ELVDD−Vth+Vdata−ELVDD".

In the first mode, a first voltage difference Vgs1 ("Vgs1=Vs−Vg1") between a source voltage Vs (Vs=ELVDD") of the first electrode of the first transistor T1 and the first gate voltage Vg1 ("Vg1=ELVDD−Vth+Vdata−Vref") of the second electrode of the first transistor T1 at the second node N2 is obtained by "Vsg1=ELVDD−ELVDD+Vth−Vdata+Vrer. In the second mode, a second voltage difference Vgs2 ("Vgs2=Vs−Vg2") between the source voltage Vs (Vs=ELVDD") of the first electrode of the first transistor T1 and the second gate voltage Vg2 ("Vg2=ELVDD−Vth+Vdata−ELVDD") of the second electrode of the first transistor T1 at the second node N2 is obtained by "Vsg2=ELVDD−ELVDD+Vth−Vdata+ELVDD".

The black period Tb may be provided between the data write period Td and the light emission period Tn. After the first write scan signal GW1 is deactivated, the data write period Td ends, and the first black scan signal GB1 may be activated.

Figure 9A:
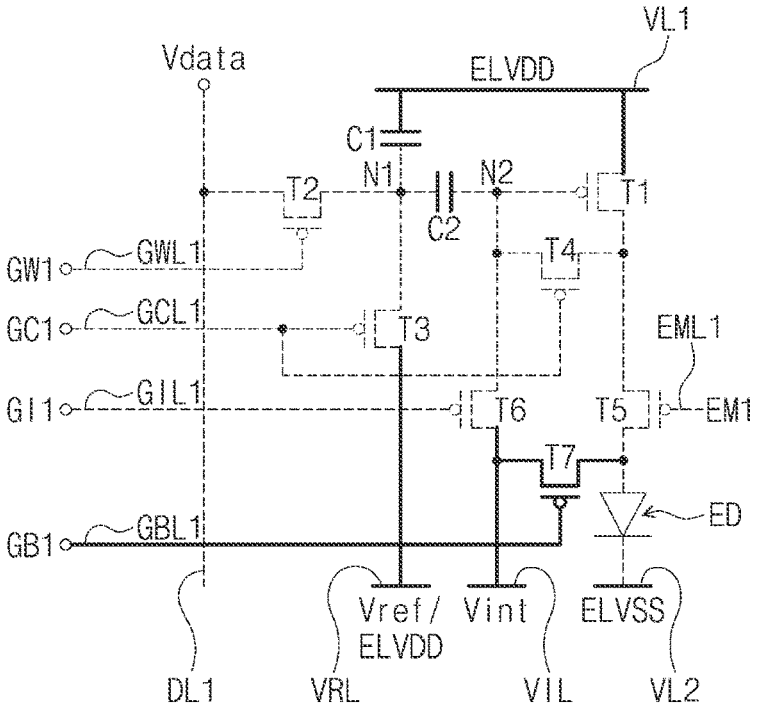
FIG. 9A is a circuit diagram showing the operation of a pixel during a black period.
Figure 9B:
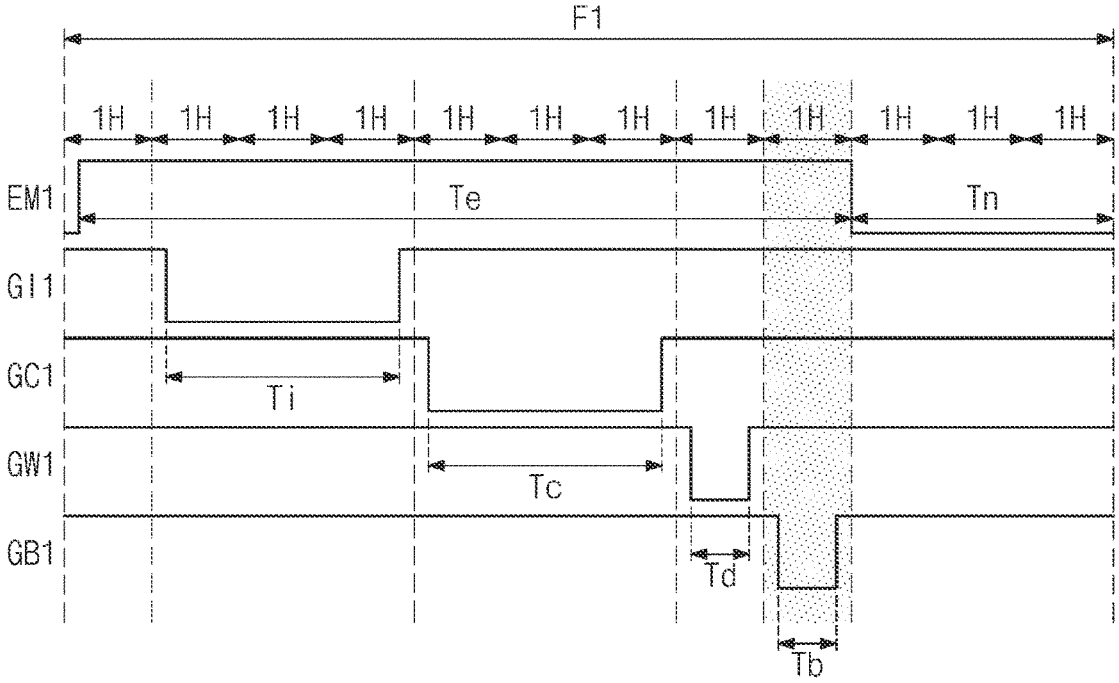
FIG. 9B is a view showing waveforms of signals during the black period of FIG. 9A.

FIG. 9A is a circuit diagram showing the operation of a pixel during the black period, and FIG. 9B is a diagram showing waveforms of signals during the black period of FIG. 9A.

Referring to FIGS. 9A and 9B, the first black scan signal GB1 may be activated during the black period Td within the non-light emission period Te. Here, the first black scan signal GB1 may have a low level during the black period Td and a high level during the deactivation period.

The first black scan signal GB1 may be applied to the seventh transistor T7 through the first black scan line GBL1, and the seventh transistor T7 is turned on during the black period Tb in which the first black scan signal GB1 is activated. During the black period Tb, the initialization voltage Vint supplied to the initialization voltage line VIL may be transmitted to the anode of the light emitting element ED through the turned-on seventh transistor T7. Then, the anode of the light emitting element ED may be initialized to the initialization voltage Vint. When the anode of the light emitting element ED is initialized to the initialization voltage Vint during the black period Td, the black characteristic of the first pixel PX11 can be improved. That is, by initializing the anode of the light emitting element ED, current leaking through the first transistor T1 may be prevented, and the first pixel PX11 may display a correct black gradation.

Thereafter, when the first light emission control signal EM1 is activated during the light emission period Tn, the fifth transistor T5 may be turned on, and a current path may be formed between the first transistor T1 and the light emitting element ED. Therefore, in the first mode, the first driving current of the first transistor T1 is applied to the light emitting element ED, and in the second mode, the second driving current of the first transistor T1 is applied to the light emitting element ED. In the first mode, the first driving current is proportional to the first driving voltage Vref-Vdata between the first voltage difference Vsg1 and the threshold voltage Vth of the first transistor T1, and in the second mode, the second driving current is proportional to the second driving voltage ELVDD-Vdata between the second voltage difference Vsg2 and the threshold voltage Vth of the first transistor T1. Since the voltage applied to the reference voltage line VRL may vary according to the operation mode of the display panel DP (shown in FIG. 2), the driving current of the light emitting element ED may vary correspondingly.

Referring to FIGS. 1, 2, 5 and 9A, the light emitting element ED of the display device DD may emit light of a different intensity due to a difference of the driving current of the light emitting element ED depending on an operation mode of the display panel DP.

Comparing the first mode in which the reference voltage Vref is applied to the reference voltage line VRL to the second mode in which the first power voltage ELVDD is applied to the reference voltage line VRL, the deviation of the potential of the first node N1 may be different between the pixels PX11 to PXnm. That is, in the first mode in which the reference voltage Vref is applied to the reference voltage line VRL, the deviation of the potential of the first node N1 between the pixels PX11 to PXnm may be small, but in the second mode in which the first power voltage ELVDD is applied to the reference voltage line VRL, the deviation of the potential of the first node N1 between the pixels PX11 to PXnm may be large. This may be because the reference voltage line VRL is supplied with the first power voltage ELVDD through the first voltage line VL1, and the amount of voltage drop of the first power voltage ELVDD based on the position may be greater than the amount of voltage drop of the reference voltage Vref.

When the reference voltage Vref having a small amount of voltage drop according to a position may be applied to the reference voltage line VRL in the first mode, for example, for displaying a still image such as document, the light emitting element ED of each of the pixels PX11 to PXnm may emit light according to the first driving current that is proportional to the first driving voltage "Vref−Vdata". That is, since the factor of the first power voltage ELVDD can be removed from the first driving current of the light emitting element ED, the amount of voltage drop of the first power voltage ELVDD may not be reflected in the luminance of each of the pixels PX11 to PXnm. Therefore, luminance deviation between the pixels PX11 to PXnm in the first mode may be reduced.

On the other hand, when the first power voltage ELVDD having a large voltage drop based on the position may be applied to the reference voltage line VRL in the second mode, for example, for displaying a video, the light emitting element ED of each of the pixels PX11 to PXnm may emit light according to the second driving current that is proportional to the second driving voltage "ELVDD−Vdata". Because the amount of voltage drop of the first power voltage ELVDD is reflected in the luminance of each of the pixels PX11 to PXnm, in a case where one screen includes an area displaying a white gradation and an area displaying a black gradation, the white gradation region may be displayed sharper.

As described above, by changing the voltage supplied to the reference voltage line VRL according to the operation mode of the display panel DP, in addition to reducing the overall luminance deviation of the display device DD, the image quality of a white area may be improved in a high-frequency driving mode.

Figure 10:
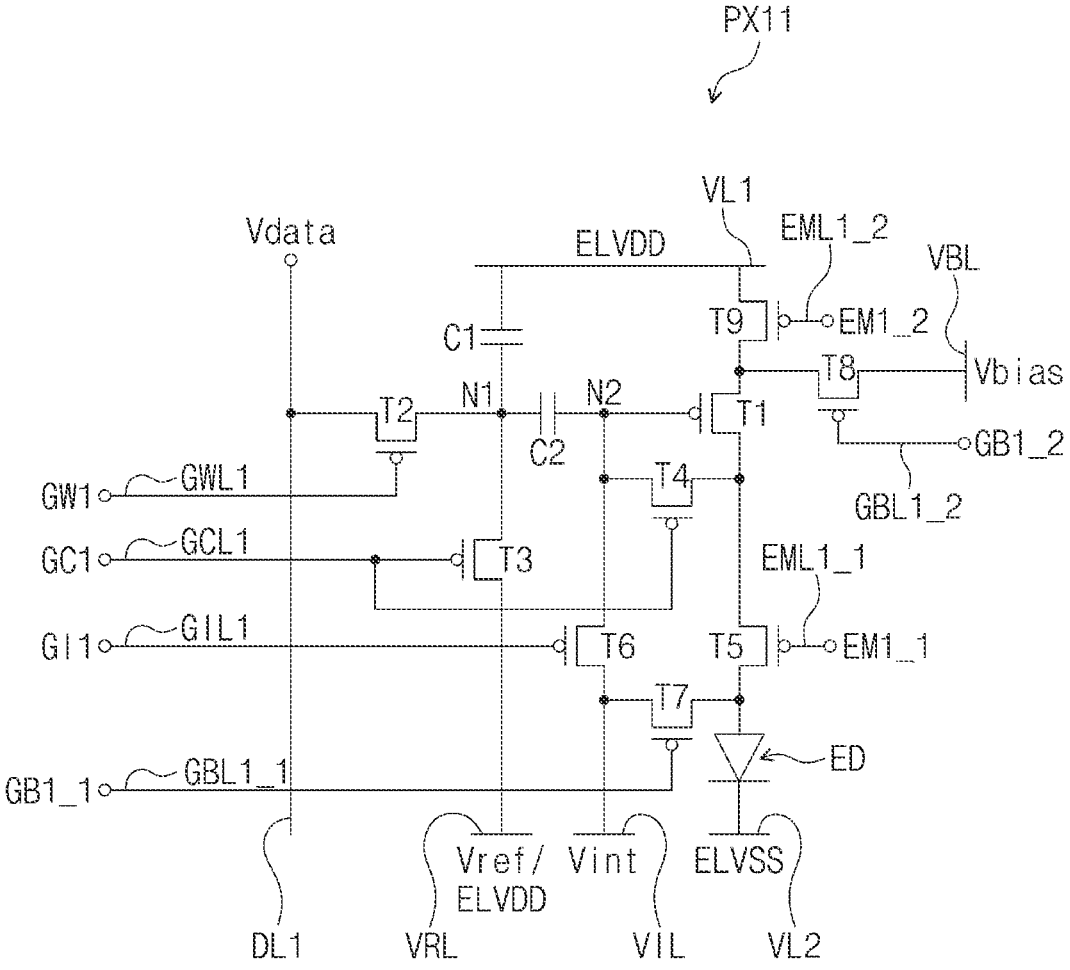
FIG. 10 is a circuit diagram of a pixel according to an embodiment of the inventive concept.

FIG. 10 is a circuit diagram of a pixel according to an embodiment of the inventive concept. The same reference numerals are used for components identical to the components shown in FIG. 5, and the detailed description thereof that is redundant will be omitted.

Referring to FIG. 10, the first pixel PX11 may include a plurality of transistors T1 to T9, two capacitors C1 and C2, and a light emitting element ED. The plurality of transistors T1 to T9 and the two capacitors C1 and C2 may control an amount of current flowing through the light emitting element ED in response to the data signal and the scan signals.

For convenience of description, the plurality of transistors T1 to T9 are referred to as first to ninth transistors T1 to T9, and the two capacitors C1 and C2 are referred to as first and second capacitors C1 and C2.

The first to seventh transistors T1 to T7 and the first and second capacitors C1 and C2 have the same connectivity as the first to seventh transistors T1 to T7 and the first and second capacitors C1 and C2 illustrated in FIG. 5. Therefore, descriptions of the first to seventh transistors T1 to T7 and the first and second capacitors C1 and C2 are omitted.

The first pixel PX11 may further include eighth and ninth transistors T8 and T9. The eighth transistor T8 may be provided between the first transistor T1 and a bias voltage line VBL. The eighth transistor T8 may include a first electrode connected to the bias voltage line VBL, a second electrode connected to a first bias scan line GBL1_2, and a third electrode connected to the first electrode of the first transistor T1. The bias voltage line VBL may supply a bias voltage Vbias, and the first bias scan line GBL1_2 may supply a first bias scan signal GB1_2. As an example of the inventive concept, the first bias scan signal GB1_2 may be activated simultaneously with the first black scan signal GB1_1 supplied to the seventh transistor T7.

The potential of the first electrode of the first transistor T1 may be reset to the bias voltage Vbias by the eighth transistor T8 during the black period Tb (shown in FIG. 9B), a constant bias voltage may be formed between the first electrode and the second electrode of the first transistor T1. Therefore, it is possible to prevent degradation of the display quality that may be caused by an increase of a potential difference between the second electrode and the first electrode of the first transistor T1 above a certain level due to a hysteresis phenomenon.

The ninth transistor T9 may be provided between the first voltage line VL1 and the first transistor T1. The ninth transistor T9 may include a first electrode connected to the first voltage line VL1, a second electrode connected to a second light emission control line EML1_2, and a third electrode connected to the first electrode of the first transistor T1. The second light emission control line EML1_2 may supply a second light emission control signal EM1_2. As an example of the inventive concept, the second electrode of the fifth transistor T5 may be connected to a first light emission control line EML1_1 that supplies a first light emission control signal EM1_1. The first and second light emission control signals EM1_1 and EM1_2 may be simultaneously activated. In this case, a current path may be formed or blocked between the first voltage line VL1 and the light emitting element ED according to the operation of the fifth and ninth transistors T5 and T9.

In the present example of the first pixel PX11 employing nine transistors and two capacitors, a voltage applied to the reference voltage line VRL may vary according to an operation mode of the display panel DP (shown in FIG. 2). That is, when the display panel DP operates in the first mode, the reference voltage Vref may be applied to the reference voltage line VRL, and when the display panel DP operates in the second mode, the first power voltage ELVDD may be applied to the reference voltage line VRL.

When the reference voltage Vref having a small amount of voltage drop according to a position may be applied to the reference voltage line VRL in the first mode, for example, for displaying a still image such as a document, the light emitting element ED of each of the pixels PX11 to PXnm may emit light according to the first driving current that is proportional to the first driving voltage "Vref−Vdata". That is, since the factor of the first power voltage ELVDD can be removed from the first driving current of the light emitting element ED, the amount of voltage drop of the first power voltage ELVDD may not be reflected in the luminance of each of the pixels PX11 to PXnm. Therefore, luminance deviation between the pixels PX11 to PXnm in the first mode may be reduced.

On the other hand, when the first power voltage ELVDD having a large voltage drop based on the position may be applied to the reference voltage line VRL in the second mode, for example, for displaying a video, the light emitting element ED of each of the pixels PX11 to PXnm may emit light according to the second driving current that is proportional to the second driving voltage "ELVDD−Vdata". Because the amount of voltage drop of the first power voltage ELVDD is reflected in the luminance of each of the pixels PX11 to PXnm, in a case where one screen includes an area displaying a white gradation and an area displaying a black gradation, sharpness of the white gradation region may be improved.

As described above, by changing the voltage supplied to the reference voltage line VRL according to the operation mode of the display panel DP, in addition to reducing the overall luminance deviation of the display device DD, the image quality of the white area may be improved in a high-frequency driving mode.

Figure 11:
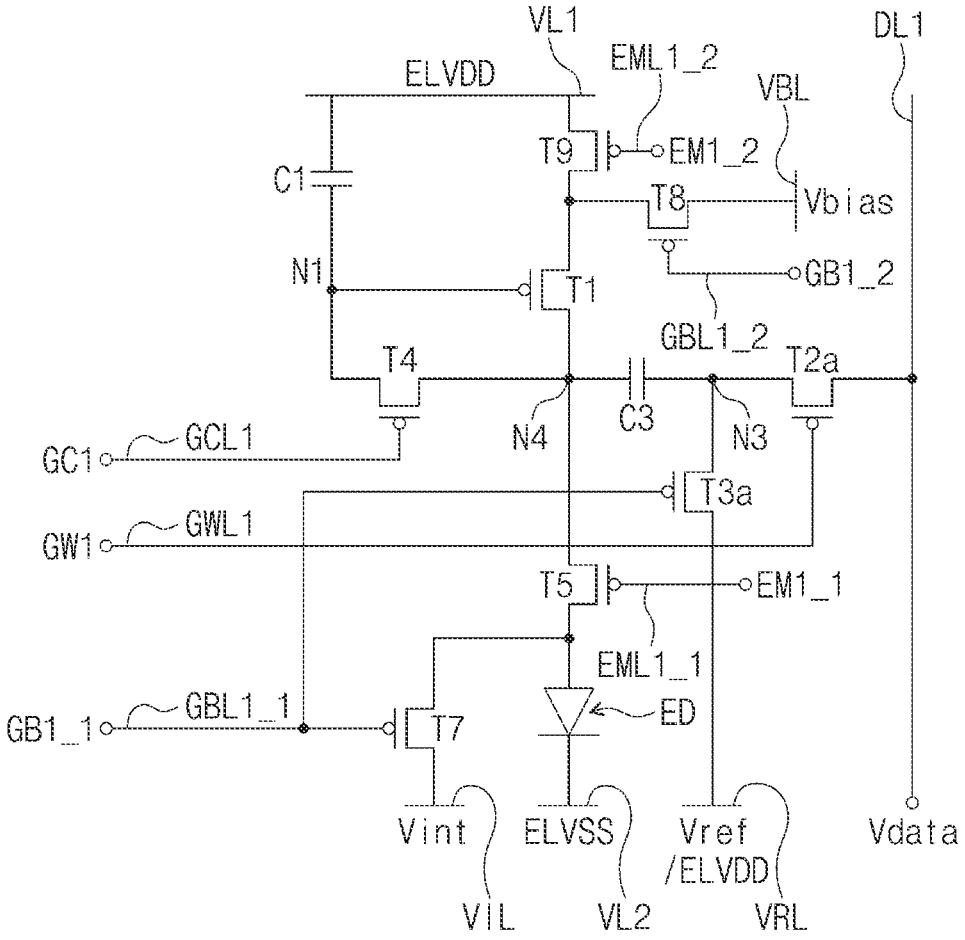
FIG. 11 is a circuit diagram of a pixel according to an embodiment of the inventive concept.
Figure 12:
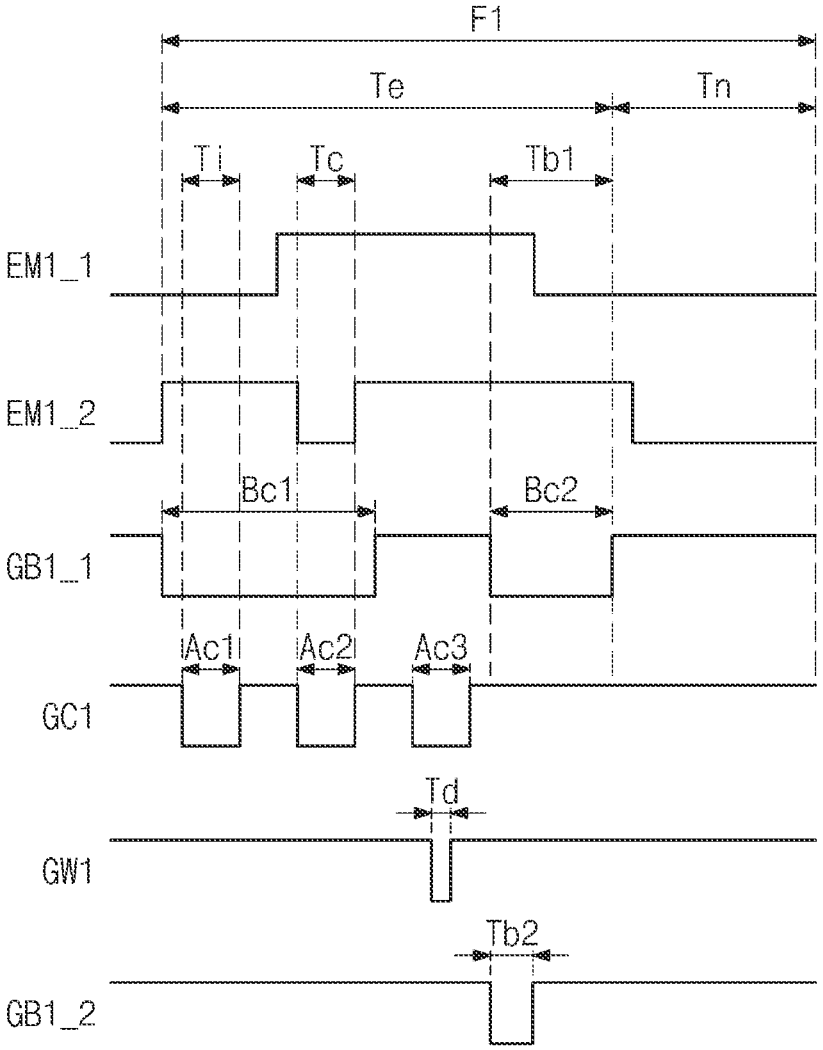
FIG. 12 is a waveform diagram showing waveforms of signals applied to the pixel illustrated in FIG. 11.

FIG. 11 is a circuit diagram of a pixel according to an embodiment of the inventive concept, and FIG. 12 is a waveform diagram showing waveforms of signals applied to the pixel illustrated in FIG. 11. The same reference numerals are used for components identical to the components shown in FIG. 5 and/or FIG. 10, and the detailed description thereof that is redundant will be omitted.

Referring to FIGS. 11 and 12, the first pixel PX11 may include a plurality of transistors T1, T2*a*, T3*a*, T4, T5, T7, T8, and T9, and two capacitors C1 and C3, and a light emitting element ED. For convenience of description, the plurality of transistors T1, T2*a*, T3*a*, T4, T5, T7, T8, and T9 are referred to as first to fifth transistors T1, T2*a*, T3*a*, T4 to T5, and seventh to ninth transistors T7 to T9, and the two capacitors C1 and C3 are referred to as first and third capacitors C1 and C3.

The first transistor T1 may be connected between the first voltage line VL1 and the light emitting element ED. The first transistor T1 may include a first electrode electrically connected to the first voltage line VL1, a second electrode connected to the first node N1, and a third electrode electrically connected to the light emitting element ED. The first transistor T1 may receive the first power voltage ELVDD through the first voltage line VL1. The third electrode of the first transistor T1 may be electrically connected to the anode of the light emitting element ED via the fifth transistor T5.

The second transistor T2*a* may be connected between the first data line DL1 and a third node N3. The second transistor T2*a* may include a first electrode connected to the first data line DL1, a second electrode connected to the first write scan line GWL1, and a third electrode connected to the third node N3. During the data write period Td, the second transistor T2*a* may be turned on in response to the first write scan signal GW1 provided to the first write scan line GWL1, and the first data line DL1 and the third node N3 may be electrically connected by the turned-on second transistor T2*a*. That is, the data voltage Vdata applied to the first data line DL1 may be transmitted to the third node N3 through the turned-on second transistor T2*a* during the data write period Td.

The first capacitor C1 may be electrically connected between the first voltage line VL1 and the first node N1, and the third capacitor C3 may be electrically connected between the third node N3 and a fourth node N4. The third capacitor C3 may include a first electrode electrically connected to the fourth node N4 and a second electrode electrically connected to the third node N3.

The third transistor T3*a* may be electrically connected between the third node N3 and the reference voltage line VRL. The third transistor T3*a* may include a first electrode connected to the reference voltage line VRL, a second electrode electrically connected to a first black scan line GBL1_1, and a third electrode electrically connected to the third node N3. The reference voltage line VRL may provide the reference voltage Vref or the first power voltage ELVDD according to an operation mode of the display panel DP.

The fourth transistor T4 may be electrically connected between the second electrode of the first transistor T1 (or the first node N1) and the third electrode of the first transistor T1. The fourth transistor T4 may include a first electrode electrically connected to the third electrode of the first transistor T1, a second electrode electrically connected to the first compensation scan line GCL1, and a third electrode electrically connected to the fourth node N4. During the compensation period Tc, the fourth transistor T4 may be turned on in response to the first compensation scan signal GC1 provided to the first compensation scan line GCL1. That is, the first transistor T1 may be diode-connected by the fourth transistor T4 that is turned on during the compensation period Tc.

The fifth transistor T5 may be electrically connected between the third electrode of the first transistor T1 and the anode of the light emitting element ED. The fifth transistor T5 may include a first electrode connected to the third electrode of the first transistor T1, a second electrode electrically connected to the first light emission control line EML1_1, and a third electrode electrically connected to the anode of the light emitting element ED. During the light emission period Tn, the fifth transistor T5 may be turned on by the first light emission control signal EM1_1 that is provided to the first light emission control line EML1_1.

The seventh transistor T7 may be electrically connected between the initialization voltage line VIL and the anode of the light emitting element ED. The seventh transistor T7 may include a first electrode connected to the anode of the light emitting element ED, a second electrode electrically connected to the first black scan line GBL1_1, and a third electrode connected to the initialization voltage line VIL. During the black period Tb, the seventh transistor T7 may be turned on in response to the first black scan signal GB1_1 that is provided to the first black scan line GBL1_1.

Referring to FIG. 12, the frame period F1 may be divided into the non-light emission period Te and the light emission period Tn according to the first and second light emission control signals EM1_1 and EM1_2. During the non-light emission period Te, at least one of the first and second light emission control signals EM1_1 and EM1_2 may have a high level, and during the light emission period Tn, both the first and second light emission control signals EM1_1 and EM1_2 may have a low level. Within the frame period F1, the first compensation scan signal GC1 may include a plurality of activation periods Ac1, Ac2, and Ac3. Although FIG. 12 illustrates a structure in which the first compensation scan signal GC1 includes three activation periods Ac1, Ac2, and Ac3 in the frame period F1, the inventive concept is not limited thereto. That is, the number of activation periods included in the first compensation scan signal GC1 may not be particularly limited. Here, for convenience of explanation, the plurality of activation periods Ac1, Ac2, and Ac3 of the first compensation scan signal GC1 are referred to as a first compensation activation period Ac1, a second compensation activation period Ac2, and a third compensation activation period Ac3. Within the frame period F1, the first black scan signal GB1_1 may include a plurality of activation periods as well. Although FIG. 12 illustrates a structure in which the first black scan signal GB1_1 includes two activation periods Bc1 and Bc2 in the frame period F1, the inventive concept is not limited thereto. That is, the number of activation periods included in the first black scan signal GB1_1 may not be particularly limited. Here, for convenience of description, the plurality of activation periods Bc1 and Bc2 of the first black scan signal GB1_1 are referred to as the first black activation period Bc1 and the second black activation period Bc2.

The first black activation period Bc1 may overlap the first compensation activation period Ac1 and the second compensation activation period Ac2. In addition, the activation period of the first light emission control signal EM1_1 may overlap the first compensation activation period Ac1 and the first black activation period Bc1.

The fifth transistor T5 may be turned on during the activation period of the first light emission control signal EM1_1, and the third and seventh transistors T3*a* and T7 may be turned on during the first black activation period Bc1. Accordingly, the initialization voltage Vint may be applied to the fourth node N4 through the turned-on seventh and fifth transistors T7 and T5. Thereafter, when the fourth transistor T4 is turned on during the first compensation activation period Ac1, the potential of the first node N1 is changed to the initialization voltage Vint. Here, the first compensation activation period Ac1 of the first compensation scan signal GC1 may be referred to as the initialization period T1.

During the first black activation period Bc1, the reference voltage Vref or the first power voltage ELVDD may be applied to the third node N3 through the turned-on third transistor T3*a*. That is, the potential of the third node N3 may have the reference voltage Vref or the first power voltage ELVDD.

Thereafter, when the first light emission control signal EM1_1 is deactivated and the second light emission control signal EM1_2 is activated, the fifth transistor T5 may be turned off, and the ninth transistor T9 may be turned on. When the fifth transistor T5 is turned off and the ninth transistor T9 is turned on, the fourth transistor T4 is turned on during the second compensation activation period Ac2. Then, the potential of the first node N1 may be compensated by the compensation voltage "ELVDD-Vth" that corresponds to the first power voltage ELVDD reduced by the threshold voltage Vth of the first transistor T1. Accordingly, the second compensation activation period Ac2 of the first compensation scan signal GC1 may be referred to as the compensation period Tc.

After the compensation period Tc ends, the first write scan signal GW1 may be activated. The activation period of the first write scan signal GW1 may be referred to as the data write period Td. As an example of the inventive concept, the initialization period T1 and the compensation period Tc may have a larger duration than that of the data write period Td.

During the data write period Td, the second transistor T2 may be turned on in response to the first write scan signal GW1 provided to the first write scan line GWL1, and the data voltage Vdata supplied to the first data line DL1 may be transmitted to the third node N3 through the turned-on second transistor T2. The third compensation activation period Ac3 of the first compensation scan signal GC1 may overlap the data write period Td. That is, the fourth transistor T4 may be turned on during the data write period Td.

During the data write period Td, the potential of the third node N3 is changed from the reference voltage Vref or the first power voltage ELVDD to the data voltage Vdata. When the reference voltage Vref is supplied to the reference voltage line VRL during the first black activation period Bc1 in the first mode, the amount of a potential change of the third node N3 corresponds to "Vdata−Vref". However, when the first power voltage ELVDD is supplied to the reference voltage line VRL during the first black activation period Bc1 in the second mode, the amount of the potential change of the third node N3 corresponds to "Vdata-ELVDD".

During the data write period Td, when the potential of the third node N3 changes from the reference voltage Vref or the first power voltage ELVDD to the data voltage Vdata, the potential of the first node N1 is changed from the compensation voltage "ELVDD-Vth" to the first gate voltage Vg1 or the second gate voltage Vg2 by the coupling of the second capacitor C2. That is, in the first mode in which the reference voltage Vref is supplied to the reference voltage line VRL during the first black activation period Bc1, the potential of the first node N1 is changed to the first gate voltage Vg1 that corresponds to "Vg1=ELVDD−Vth+Vdata−Vref". Meanwhile, in the second mode in which the first power voltage ELVDD is supplied to the reference voltage line VRL during the first black activation period Bc1, the potential of the first node N1 is changed to the second gate voltage Vg2 that corresponds to "Vg2=ELVDD−Vth+Vdata−ELVDD".

In the first mode, the first voltage difference Vgs1 ("Vgs1=Vs−Vg1") between a source voltage Vs (Vs=ELVDD") of the first electrode of the first transistor T1 and the first gate voltage Vg1 ("Vg1=ELVDD−Vth+Vdata−Vref") of the second electrode of the first transistor T1 at the first node N1 is obtained by "Vsg1=ELVDD−ELVDD+Vth−Vdata+Vrer. In the second mode, the second voltage difference Vgs2 ("Vgs2=Vs−Vg2") between the source voltage Vs (Vs=ELVDD") of the first electrode of the first transistor T1 and the second gate voltage Vg2 ("Vg2=ELVDD−Vth+Vdata−ELVDD") of the second electrode of the first transistor T1 at the first node N1 is obtained by "Vsg2=ELVDD−ELVDD+Vth−Vdata+ELVDD".

A black period Tb1 may be provided between the data write period Td and the light emission period Tn. After the first write scan signal GW1 is deactivated, the data write period Td ends, and the second black activation period Bc2 of the first black scan signal GB1_1 may be activated.

During the second black activation period Bc2, the seventh transistor T7 may be turned on, and the initialization voltage Vint supplied to the initialization voltage line VIL may be transmitted to the anode of the light emitting element ED through the turned-on seventh transistor T7. Then, the anode of the light emitting element ED may be initialized to the initialization voltage Vint. When the anode of the light emitting element ED is initialized to the initialization voltage Vint during the second black activation period Bc2, the black characteristic of the first pixel PX11 may be improved. That is, by initializing the anode of the light emitting element ED, current leak through the first transistor T1 may be prevented, and the first pixel PX11 may display a correct black gradation. Here, the second black activation period Bc2 may be referred to as the black period Tb1.

Thereafter, when the first and second light emission control signals EM1_1 and EM1_2 are activated during the light emission period Tn, the fifth and ninth transistors T5 and T9 may be turned on, and a current path may be formed between the first transistor T1 and the light emitting element ED. Therefore, in the first mode, the first driving current of the first transistor T1 is applied to the light emitting element ED, and in the second mode, the second driving current of the first transistor T1 is applied to the light emitting element ED. In the first mode, the first driving current is proportional to the first driving voltage "Vref-Vdata" between the first voltage difference Vsg1 and the threshold voltage Vth of the first transistor T1, and in the second mode, the second driving current is proportional to the second driving voltage "ELVDD-Vdata" between the second voltage difference Vsg2 and the threshold voltage Vth of the first transistor T1. Since the voltage applied to the reference voltage line VRL may vary according to the operation mode of the display panel DP (shown in FIG. 2), the driving current of the light emitting element ED may vary correspondingly.

As an example of the inventive concept, the second electrodes of the third and seventh transistors T3*a* and T7 may be commonly connected to the first black scan line GBL1_1, but the inventive concept is not limited thereto. That is, the second electrode of the third transistor T3*a* and the second electrode of the seventh transistor T7 may be connected to different scan lines and receive different scan signals.

Further, the eighth transistor T8 may be turned on by the bias scan signal GB1_2 during a bias period Tb2, and the potential of the first electrode of the first transistor T1 may be reset to the bias voltage Vbias. Therefore, a constant bias voltage may be formed between the first electrode and the second electrode of the first transistor T1 during the bias period Tb2. As an example of the inventive concept, within the frame period F1, the initialization period T1, the compensation period Tc, and the data write period Td may precede the bias period Tb2. In the frame period F1, the bias period Tb2 may overlap the black period Tb1.

In the present example of the first pixel PX11 employing eight transistors and two capacitors, a voltage applied to the reference voltage line VRL may vary according to an operation mode of the display panel DP (shown in FIG. 2). That is, when the display panel DP operates in the first mode, the reference voltage Vref may be applied to the reference voltage line VRL, and when the display panel DP operates in the second mode, the first power voltage ELVDD may be applied to the reference voltage line VRL.

When a reference voltage Vref having a small amount of voltage drop according to a position may be applied to the reference voltage line VRL in the first mode, for example, for displaying a still image such as a document, the light emitting element ED of each of the pixels PX11 to PXnm may emit light according to the first driving current that is proportional to the first driving voltage "Vref−Vdata". That is, since the factor of the first power voltage ELVDD can be removed from the first driving current of the light emitting element ED, the amount of voltage drop of the first power voltage ELVDD may not be reflected in the luminance of each of the pixels PX11 to PXnm. Therefore, luminance deviation between the pixels PX11 to PXnm in the first mode may be reduced.

On the other hand, when the first power voltage ELVDD having a large voltage drop based on the position may be applied to the reference voltage line VRL in the second mode, for example, for displaying a video, the light emitting element ED of each of the pixels PX11 to PXnm may emit light according to the second driving current that is proportional to the second driving voltage "ELVDD−Vdata". Because the amount of voltage drop of the first power voltage ELVDD is reflected in the luminance of each of the pixels PX11 to PXnm, in a case where one screen includes an area displaying a white gradation and an area displaying a black gradation, sharpness of the white gradation region may be improved.

As described above, by changing the voltage supplied to the reference voltage line VRL according to the operation mode of the display panel DP, in addition to reducing the overall luminance deviation of the display device DD, the image quality of the white area may be improved in a high-frequency driving mode.

Although the exemplary embodiments of the inventive concept have been described, it is understood that the inventive concept should not be limited to these exemplary embodiments but various changes and modifications can be made by one ordinary skilled in the art within the spirit and scope of the inventive concept as hereinafter claimed.

What is claimed is:

1. A display device comprising:

a display panel including a pixel, a voltage line supplying a power voltage to the pixel, and a reference voltage line supplying one of a reference voltage and the power voltage to the pixel;

a mode selector configured to output one of a first selection signal and a second selection signal according to an operation mode of the display panel; and a switch configured to provide the reference voltage or the power voltage to the reference voltage line in response to one of the first selection signal and the second selection signal, the pixel comprises:

a light emitting element including a cathode and an anode;

a first transistor connected between the anode of the light emitting element and the voltage line;

a second transistor connected between a data line that provides a data signal and the first transistor; and a third transistor connected between the reference voltage line and the second transistor.

2. The display device of claim 1, wherein the switch comprises:

a first switching element configured to supply the reference voltage to the reference voltage line in response to the first selection signal; and a second switching element configured to supply the power voltage to the reference voltage line in response to the second selection signal.

3. The display device of claim 2, wherein when the display panel operates in a first mode for displaying a still image, the mode selector activates the first selection signal, and wherein when the display panel operates in a second mode for displaying a video, the mode selector activates the second selection signal.

4. The display device of claim 2, wherein the display panel comprises a display area in which a plurality of pixels is arranged and a peripheral area adjacent to the display area, and wherein the first switching element and the second switching element are disposed in the peripheral area of the display panel.

5. The display device of claim 2, wherein the second switching element receives the power voltage through the voltage line.

6. The display device of claim 1, wherein the pixel further comprises:

a first capacitor connected between a first node and the voltage line; and a second capacitor connected between the first transistor and the second transistor.

7. The display device of claim 6, wherein the first transistor comprises:

a first electrode connected to the voltage line, a second electrode connected to the second capacitor at a second node; and a third electrode connected to the anode of the light emitting element, and wherein the second transistor comprises:

a first electrode connected to the data line;

a second electrode configured to receive a write scan signal; and a third electrode connected to the first node.

8. The display device of claim 7, wherein the third transistor includes a first electrode connected to the reference voltage line, a second electrode configured to receive a compensation scan signal, and a third electrode connected to the first node.

9. The display device of claim 8, wherein an activation period of the compensation scan signal has a first duration that is longer than a second duration of an activation period of the write scan signal.

10. The display device of claim 9, wherein the compensation scan signal is activated before the write scan signal is activated.

11. The display device of claim 8, wherein the pixel further comprises:

a fourth transistor including a first electrode connected to the second electrode of the first transistor, a second electrode configured to receive the compensation scan signal, and a third electrode connected to the third electrode of the first transistor; and a fifth transistor including a first electrode connected to the third electrode of the first transistor, a second electrode configured to receive a light emission control signal, and a third electrode connected to the anode of the light emitting element.

12. The display device of claim 11, wherein the compensation signal within the deactivation period of the light emission control signal is activated before the write scan signal is activated.

13. The display device of claim 7, wherein the pixel further comprises:

a sixth transistor including a first electrode connected to an initialization voltage line, a second electrode configured to receive an initialization scan signal, and a third electrode connected to the second electrode of the first transistor; and a seventh transistor including a first electrode connected to the initialization voltage line, a second electrode configured to receive a black scan signal, and a third electrode connected to the anode of the light emitting element.

14. The display device of claim 13, wherein the compensation scan signal is activated before the write scan signal is activated, and wherein the initialization scan signal is activated before the compensation scan signal is activated.

15. The display device of claim 14, wherein a first activation period of the compensation scan signal and a second activation period of the initialization scan signal are greater than a third activation period of the write scan signal.

16. The display device of claim 13, wherein the write scan signal is activated before the black scan signal is activated.

17. A display device comprising:

a display panel including a pixel, a voltage line supplying a power voltage to the pixel, and a reference voltage line supplying one of a reference voltage and the power voltage to the pixel;

a mode selector configured to output one of a first selection signal and a second selection signal according to an operation mode of the display panel; and a switch configured to provide the reference voltage or the power voltage to the reference voltage line in response to one of the first selection signal and the second selection signal, wherein the pixel comprises:

a light emitting element including a cathode and an anode;

a first transistor connected between the anode of the light emitting element and the voltage line;

a second transistor connected between a data line that provides a data signal and the first transistor;

a first capacitor connected between a first node and the voltage line;

a second capacitor connected between the first transistor and the second transistor; and a third transistor connected between the reference voltage line and the second transistor, wherein the third transistor is turned on during a compensation period for compensating a potential of the first node, and the compensation period precedes a data write period in which the data signal is applied.

18. The display device of claim 17, wherein the first transistor comprises:

a first electrode connected to the voltage line, a second electrode connected to the second capacitor at a second node; and a third electrode connected to the anode of the light emitting element, wherein the second transistor comprises:

a first electrode connected to the data line;

a second electrode configured to receive a write scan signal; and a third electrode connected to the first node, and wherein the third transistor comprises:

a first electrode connected to the reference voltage line;

a second electrode configured to receive a compensation scan signal; and a third electrode connected to the first node.

19. The display device of claim 17, wherein the switch comprises:

a first switching element configured to supply the reference voltage to the reference voltage line in response to the first selection signal; and a second switching element configured to supply the power voltage to the reference voltage line in response to the second selection signal.

20. The display device of claim 19, wherein the second switching element receives the power voltage through the voltage line.

21. A display device comprising:

a display panel including a pixel, a voltage line supplying a first power voltage to the pixel, and a reference voltage line supplying a second power voltage to the pixel, wherein the pixel comprises:

a first transistor connected between the anode of the light emitting element and the voltage line;

a second transistor connected between a data line and the first transistor;

a third transistor connected between the reference voltage line and the second transistor; and a capacitor connected between the first transistor and the third transistor, wherein the display panel operates in a first mode and a second mode, and the first power voltage has a first voltage level in the first and second modes, wherein the second power voltage has a second voltage level in the first mode and has the first voltage level in the second mode, wherein the first voltage level is different from the second voltage level.

* * * * *